US007802444B2

(12) United States Patent
Landers et al.

(10) Patent No.: US 7,802,444 B2
(45) Date of Patent: Sep. 28, 2010

(54) ICE/BEVERAGE DISPENSER WITH IN-LINE ICE CRUSHER

(75) Inventors: Jerry L. Landers, Memphis, IN (US); Gregory K. Thompson, Louisville, KY (US); William Derek Slone, Sellersburg, IN (US); Greg A. Glass, Floyds Knobs, IN (US); John M. Grady, Sellersburg, IN (US)

(73) Assignee: Manitowoc Foodservice Companies, LLC, Manitowoc, WI (US)

( * ) Notice: Subject to any disclaimer, the term of this patent is extended or adjusted under 35 U.S.C. 154(b) by 563 days.

(21) Appl. No.: 11/514,715

(22) Filed: Sep. 1, 2006

(65) Prior Publication Data

US 2007/0193299 A1 Aug. 23, 2007

Related U.S. Application Data

(60) Provisional application No. 60/713,983, filed on Sep. 2, 2005.

(51) Int. Cl.
*F25C 5/18* (2006.01)

(52) U.S. Cl. ..... 62/320; 62/389; 62/241; 62/DIG. 17

(58) Field of Classification Search ..... 62/389
See application file for complete search history.

(56) References Cited

U.S. PATENT DOCUMENTS 1,999,108 A 4/1935 Osuch
2,645,910 A 7/1953 Leeson (Continued)

FOREIGN PATENT DOCUMENTS

JP 10059495 A 3/1998

(Continued)

OTHER PUBLICATIONS

Brochure, "Clawson PC-2000" 3 pages (undated but prior to Sep. 2, 2005).

*Primary Examiner*—Cheryl J Tyler
*Assistant Examiner*—Lakiya Rogers
(74) *Attorney, Agent, or Firm*—Brinks Hofer Gilson & Lione; Steven P. Shurtz

(57) ABSTRACT

An ice crusher is attached to an ice dispenser or to a combined ice and beverage dispenser. The ice crusher occupies minimal space in order to fit the dispenser into an existing space on a serving counter or in a beverage dispensing area. The ice crusher may also elevate the ice. In embodiments using this technique, the outlet of the ice from the ice crusher is higher than the ice inlet. As the ice flows from a source of ice, such as an ice bin, the ice is elevated while it is being crushed. The ice then flows from the outlet of the ice crusher down an ice chute or other outlet of the ice crusher, into a cup or container as desired. Other embodiments convey the ice without lifting it, and still other embodiments dispense either crushed or cubed ice, as the consumer may select. In one embodiment the selected crushed ice or cubed ice are both dispensed though the same ice dispensing chute. A retrofit kit may be used to add an ice crusher to an existing ice dispenser, or to an existing combined ice and beverage dispenser.

19 Claims, 21 Drawing Sheets

U.S. PATENT DOCUMENTS 2,779,165 A * 1/1957 Pichler et al. ..... 62/320
3,156,103 A 11/1964 Ross
3,602,441 A 8/1971 Alvarez
3,697,005 A 10/1972 Lundlin et al.
3,889,888 A 6/1975 Prada
4,075,865 A 2/1978 Wills
4,168,805 A * 9/1979 Taylor ..... 241/101.2
4,176,527 A 12/1979 Linstromberg et al.
4,209,999 A 7/1980 Falk et al.
4,257,237 A 3/1981 Hoenisch
4,276,750 A 7/1981 Kawasumi
4,448,032 A 5/1984 Hibino et al.
D274,596 S 7/1984 Madl et al.
4,505,130 A 3/1985 Hibino et al.
4,555,913 A 12/1985 Ishiguro
4,577,473 A 3/1986 Ishiguro
4,580,410 A 4/1986 Toya
4,602,489 A 7/1986 Hara
4,619,117 A 10/1986 Ito
4,619,380 A 10/1986 Brooks
4,627,556 A 12/1986 Brooks
4,653,281 A 3/1987 Van Der Veer
4,662,182 A 5/1987 Tsukiyama et al.
4,773,233 A 9/1988 Kawasumi et al.
4,856,682 A * 8/1989 Miller et al. ..... 222/238
4,910,974 A 3/1990 Hara
4,972,999 A 11/1990 Grace
5,007,591 A * 4/1991 Daniels, Jr. ..... 241/37.5
5,025,637 A 6/1991 Hara
5,027,610 A 7/1991 Hara
5,033,273 A 7/1991 Buchser et al.
5,035,118 A 7/1991 Hara
5,050,777 A 9/1991 Buchser
5,050,809 A 9/1991 Rupp
5,054,654 A * 10/1991 Schroeder et al. ..... 222/146.6
5,056,688 A 10/1991 Goetz et al.
5,065,584 A 11/1991 Byczynski et al.
5,105,631 A 4/1992 Watanabe et al.
5,105,632 A 4/1992 Naruse
5,125,242 A * 6/1992 von Blanquet ..... 62/320
5,139,183 A 8/1992 Buchser et al.
5,148,996 A 9/1992 Fletcher et al.
5,169,075 A 12/1992 Galanty
5,236,133 A 8/1993 Lundquist
5,242,125 A * 9/1993 Rupp ..... 241/93
5,273,219 A 12/1993 Beach, Jr. et al.
5,279,408 A 1/1994 Watanabe
5,405,052 A 4/1995 Sawyer, III
5,419,151 A 5/1995 Minari et al.
5,524,448 A 6/1996 Schwanebeck et al.
5,533,352 A 7/1996 Bahel et al.
5,553,744 A * 9/1996 Sawyer, III ..... 222/64
5,697,561 A 12/1997 Plank et al.
5,752,393 A 5/1998 Schlosser et al.
5,806,330 A 9/1998 Falkowski et al.
5,878,583 A 3/1999 Schlosser et al.
5,910,164 A 6/1999 Snelling et al.
6,050,097 A 4/2000 Nelson et al.
6,058,731 A 5/2000 Byczynski et al.
6,058,732 A 5/2000 Kato et al.
6,082,130 A 7/2000 Pastryk et al.
6,101,833 A 8/2000 Suzuki
6,109,476 A 8/2000 Thompson et al.
6,119,469 A 9/2000 Elwood
6,120,685 A 9/2000 Carlson et al.
6,122,927 A 9/2000 Moore
6,148,621 A 11/2000 Byczynski et al.
6,216,479 B1 4/2001 Elwood
6,257,009 B1 7/2001 Tsuchikawa
6,303,031 B1 10/2001 Senner et al.
6,349,556 B1 2/2002 Barnett et al.
6,355,177 B2 3/2002 Senner et al.
6,375,834 B1 4/2002 Guess et al.
6,438,973 B1 8/2002 Yoshida et al.
6,442,954 B1 * 9/2002 Shapiro et al. ..... 62/137
6,453,696 B1 9/2002 Kawasumi et al.
6,484,530 B1 11/2002 Hibino et al.
6,502,416 B2 1/2003 Kawasumi et al.
D471,059 S 3/2003 Chuang
6,612,126 B2 9/2003 Kawasumi et al.
6,613,236 B1 9/2003 Guess et al.
D483,985 S 12/2003 Huang
6,655,166 B1 * 12/2003 Williams ..... 62/320
6,684,656 B2 2/2004 Gray et al.
6,698,621 B2 3/2004 Landers et al.
6,705,107 B2 3/2004 Schlosser et al.
6,761,036 B2 7/2004 Teague et al.
6,795,871 B2 9/2004 Nolan et al.
7,082,782 B2 8/2006 Schlosser et al.
7,278,275 B2 10/2007 Voglewede et al.
2002/0053616 A1 5/2002 Rupp
2003/0230108 A1 * 12/2003 Lucas et al. ..... 62/344
2004/0216474 A1 * 11/2004 Jablonski et al. ..... 62/137
2004/0226312 A1 11/2004 Miller et al.
2004/0233781 A1 11/2004 Dickson
2006/0059939 A1 * 3/2006 An et al. ..... 62/344
2006/0168984 A1 8/2006 Myers
2006/0169721 A1 8/2006 Hammonds

FOREIGN PATENT DOCUMENTS

JP 10174556 A 6/1998
WO WO 2007/028029 3/2007

* cited by examiner

ICE/BEVERAGE DISPENSER WITH IN-LINE ICE CRUSHER

REFERENCE TO EARLIER FILED APPLICATION

The present application claims the benefit under 35 U.S.C. §119(e) of Provisional U.S. Patent Application Ser. No. 60/713,983, filed Sep. 2, 2005; which is hereby incorporated by reference in its entirety.

TECHNICAL FIELD

The technical field of the invention is that of ice dispensers, and ice and beverage dispensers.

BACKGROUND

Commercial ice dispensers, such as those used in fast-service restaurants, are built in a compact design to increase the ice storage area within a given space. Many customers of fast-service restaurants, as well as consumers generally, are accustomed to having ice in their beverage. Of course, this means that there must be an ice dispenser nearby, or the beverage dispenser may include an ice bin and an ice dispenser. In some applications, such as one depicted in U.S. Pat. No. 6,761,036, assigned to the assignee of this invention, the beverage dispenser may even include an ice maker so that users need not manually transport ice, such as cubed ice, into the ice bin for later dispensing by customers or by store personnel. In addition to standard cubed or shaped ice, consumers have come to appreciate shaved or crushed ice in their beverages. The smaller flakes or shavings, with much greater surface area, are able to cool a beverage much more quickly than a standard cube of ice. People also enjoy the feel of crushed ice in their mouths, and are better able to chew crushed ice.

One problem with dispensing ice is that ice makers, ice bins and ice dispensers require space in very crowded serving and dining areas. Space is sufficiently limited that ice dispensers have been integrated into beverage dispensers to save space, and ice makers, as mentioned above, have been integrated into beverage dispensers in order to avoid placement of an extra machine into dining or serving areas. Of course, if crushed or flaked ice is now desired, that may mean another machine is needed, such as an ice crusher, or adapting an existing ice maker or beverage dispenser to add an ice crusher. The same problem of lack of space acts as a barrier to the addition of an ice maker or an ice crusher. Dispensing previously-crushed ice is difficult, as in U.S. Pat. No. 6,109,476, since the ice tends to form clumps in the ice bin and may not readily be conveyed from the bin.

In addition, the design of beverage dispensers typically does not allow room for a crusher to be easily placed into an existing dispenser. In particular, if an ice crusher is to be added to a beverage dispenser with an ice bin, especially if an ice maker is also included above the ice bin, there should be sufficient room (height) between the ice bin and the beverage dispenser to fit in the ice crusher. Low ceilings or other obstacles to height may make this additional height objectionable. What is needed is therefore an ice crusher that will dispense ice from an ice bin and will crush ice from the ice bin without adding to the height of an existing machine

BRIEF SUMMARY

An ice dispenser with an integrated ice crusher has been invented which now makes it possible to provide crushed ice at the point of ice delivery to a customer's cup. The small size and arrangement of the ice crusher allows the ice crusher to be integrated into the dispenser without significantly increasing either the height or footprint of the dispenser. The integrated ice crusher can also be used on a combined ice and beverage dispenser. Preferred ice and beverage dispensers allow for the delivery of either crushed or cubed ice according to the consumer's choice.

In a first aspect, the invention is a combination of an ice dispenser with an ice crusher. The combination includes a non-refrigerated ice bin; an ice crusher housing having an inlet connected to the ice bin; an ice crusher within the ice crusher housing; and an outlet for crushed ice from the ice crusher housing. In one embodiment the ice crusher includes at least one rotating and at least one non-rotating crusher blade within the ice crusher housing.

In a second aspect, the invention is a combination of a beverage dispenser and an ice crusher. The combination includes a beverage dispenser having an ice bin with a cold plate, wherein syrup for at least one beverage is routed through tubing in the cold plate. The combination also includes an ice crusher housing having an inlet connected to the ice bin; an ice crusher within the ice crusher housing; and a crushed ice outlet from the ice crusher housing.

Another aspect of the invention is a method for crushing and dispensing ice from an ice dispenser. The method comprises transferring ice from a non-refrigerated ice bin to an ice crusher housing containing an ice crusher; crushing ice in the ice crusher; and conveying crushed ice through an outlet from the housing of the ice crusher.

In another aspect, the invention is a method of operating a beverage dispenser with an integrated ice dispenser, the beverage dispenser having at least one mixing and dispensing valve for mixing a syrup and water and dispensing a beverage. The method includes a) selecting whether crushed ice or cubed ice is to be dispensed and activating ice dispensing; b) in response to a selection of crushed ice in step a), i) causing ice cubes to be delivered to an ice crusher housing; ii) crushing the ice cubes in the ice crusher housing, and iii) delivering the resulting crushed ice to an ice dispensing chute; and c) in response to a selection of cubed ice in step a), delivering cubed ice to the ice despising chute.

In still another aspect, the invention is a method of operating a combined ice and beverage dispenser, wherein the beverage dispenser comprises at least one mixing and dispensing valve for mixing a syrup and water and dispensing a beverage, and wherein the ice dispenser is equipped with an ice crusher. The method includes a) selecting whether crushed ice or cubed ice is to be dispensed and, when crushed ice is selected, b) causing cubed ice to pass into the ice crusher, and c) activating the ice crusher, thereby crushing the ice.

A further aspect of the invention is a combined ice and beverage dispenser having at least one mixing and dispensing valve for mixing a syrup and water and dispensing a beverage, an ice bin, first and second openings out of the ice bin, an ice crusher and a selector for selecting whether the dispenser will deliver cubed ice or crushed ice.

A still further aspect of the invention is a combined ice and beverage dispenser having at least one mixing and dispensing valve for mixing a syrup and water and dispensing a beverage, an ice bin, first and second openings out of the ice bin, an ice crusher and two dispensing chutes, one for cubed ice and one for crushed ice.

Another aspect of the invention is a retrofit kit for adding an ice crusher to an existing ice dispenser. The retrofit kit includes an ice crusher in an ice crusher housing attachable to the existing ice dispenser and an ice dispensing chute attachable to the ice crusher housing.

There are many other aspects and embodiments of the invention, only a few of which are described in the attached drawings and in the presently preferred embodiments below. With the preferred embodiments, restaurateurs are able to provide crushed ice with virtually no increase in the equipment footprint. Users are able to enjoy crushed ice with the same degree of timeliness and convenience that they are accustomed to for cubed ice.

DETAILED DESCRIPTION OF THE PREFERRED EMBODIMENTS

The terms "cubed ice" and "ice cubes" as used herein and in the claims refers to ice frozen in a piece, regardless of its shape. Ice cubes can be rectangular in shape, round, or of some other shape.

Figure 4:
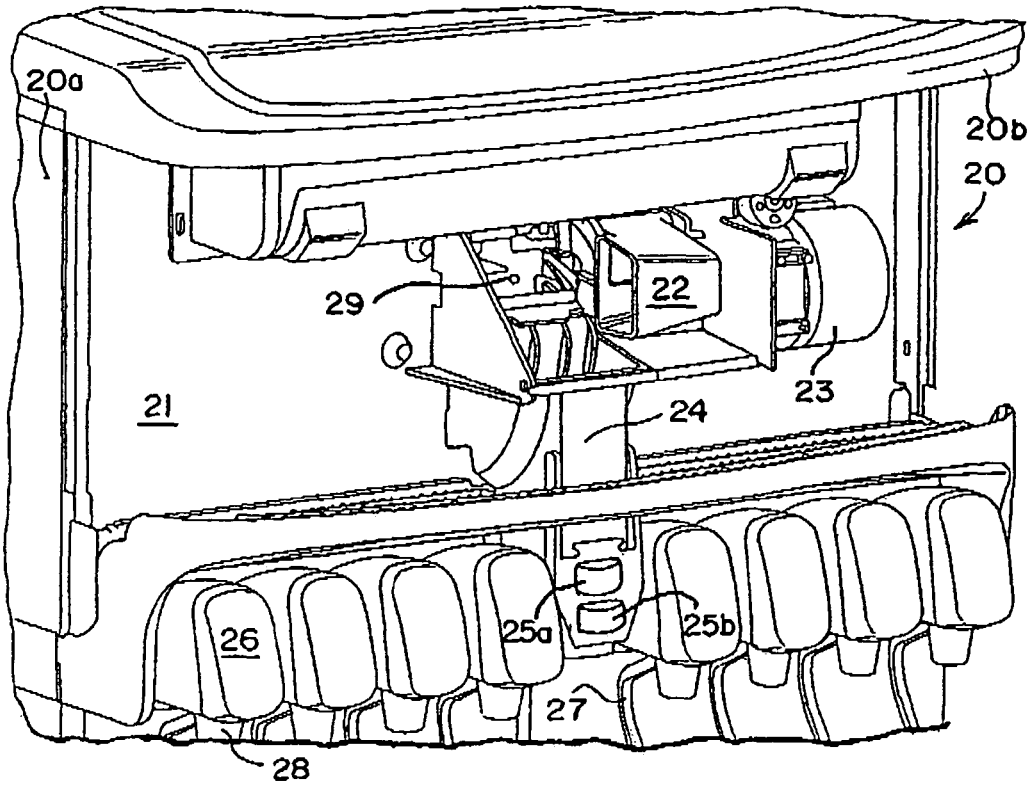
FIG. 4 depicts a front perspective view of another embodiment, a beverage dispenser with an integral ice crusher.
Figure 6:
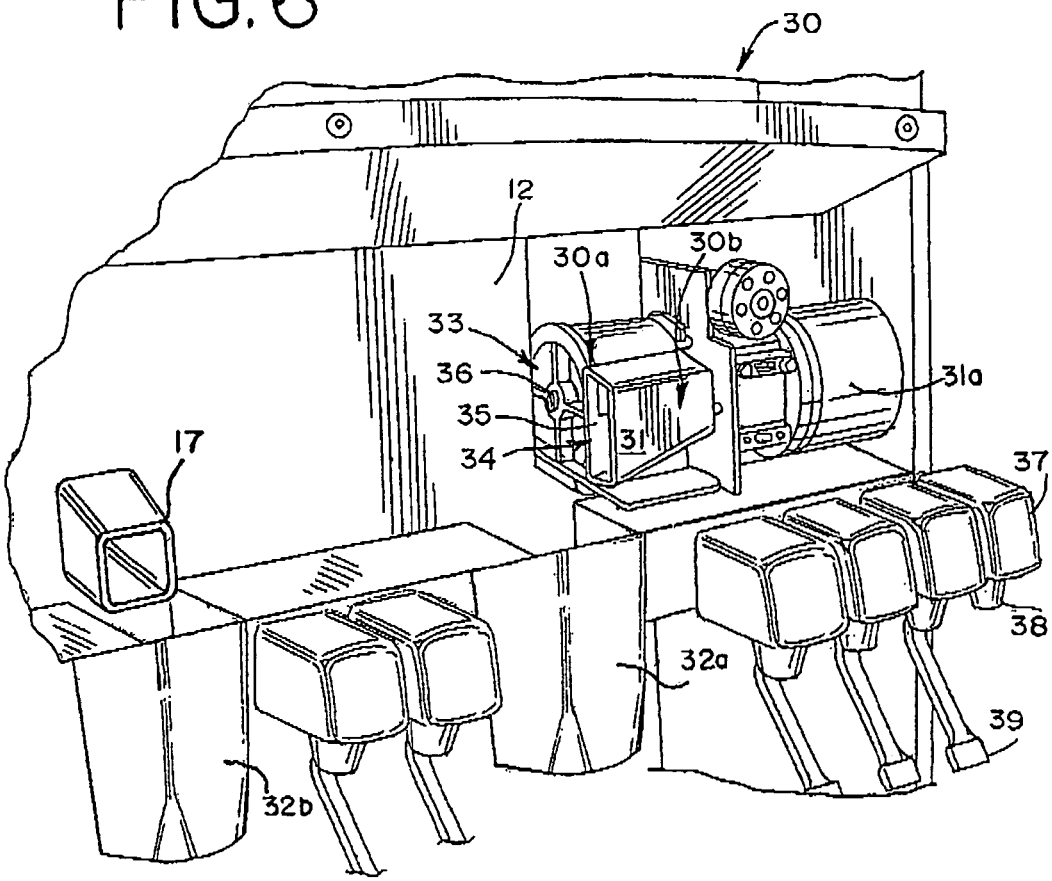
FIG. 6 is a front perspective view of another embodiment, an ice crusher integrally mounted on a beverage dispenser with a second dispenser for cubed ice.

There are many embodiments of this invention. Preferred embodiments include an ice dispenser with an ice crusher that dispenses and crushes ice (FIG. 1), and combined ice and beverage dispensers with an ice crusher. In this later category there are three types of equipment: those that dispense both crushed and cubed ice through the same ice dispensing chute (FIG. 4 shows one embodiment of this type and FIGS. 18-22 show another embodiment of this type), those that dispense crushed and cubed ice though different dispensing chutes (FIG. 6 shows one embodiment of this type and FIGS. 23-26 show another embodiment of this type), and those that dispense only crushed ice (not shown in any particular figures).

While other types of ice crushing mechanisms may be used, in general the above embodiments envision an ice crusher with one or more crushing blades rotating in a vertical plane. The ice crusher may be designed and mounted so that the vertical plane is perpendicular to, or parallel with, the front of the dispenser. The ice may thus travel in a straight, downward line from the ice bin to the crusher to a dispensing chute and into a cup of a user. In other embodiments, the ice may make a right-angle turn from the ice bin into the ice crusher, or may make a right angle turn from the ice crusher or crushed-ice holding area into a dispensing chute. In addition, other embodiments include designing and mounting the ice crusher so that the crushing blades rotate in a horizontal plane, with ice entering from one side and leaving from an opposite side, and then making a downward turn into a dispensing chute.

In the preferred embodiments, the crushing device is placed between the ice outlet from the bin and the top of the ice dispensing chute. To accomplish this, the crusher may lift ice as well as perform the crushing action. The drawings generally depict an ice crusher with a rotating set of breaker bars (rotating blades or cutters) that lift the ice as well as push it against another set of bars (non-rotating bars or cutters), which are stationary, held in place by grooves in the crusher housing. As the ice passes through the stationary bars, wipers on the stationary bars block the path of the ice and direct the crushed ice to the ice crusher housing outlet In preferred embodiments depicted herein, ice is raised in elevation between a place in the ice crusher housing where the crushed ice is formed and the crushed ice outlet. The crushed ice outlet may include a holding area from which crushed ice is dispensed, as discussed below. In those embodiments, the crushed ice sits in a downward-angled chamber, which is closed off by a door that opens to allow ice to be dispensed. Below the door is a catch device, which collects melting ice particles and water droplets and moves them toward a drain so unsightly dripping does not occur from the ice dispensing chute.

Figure 1:
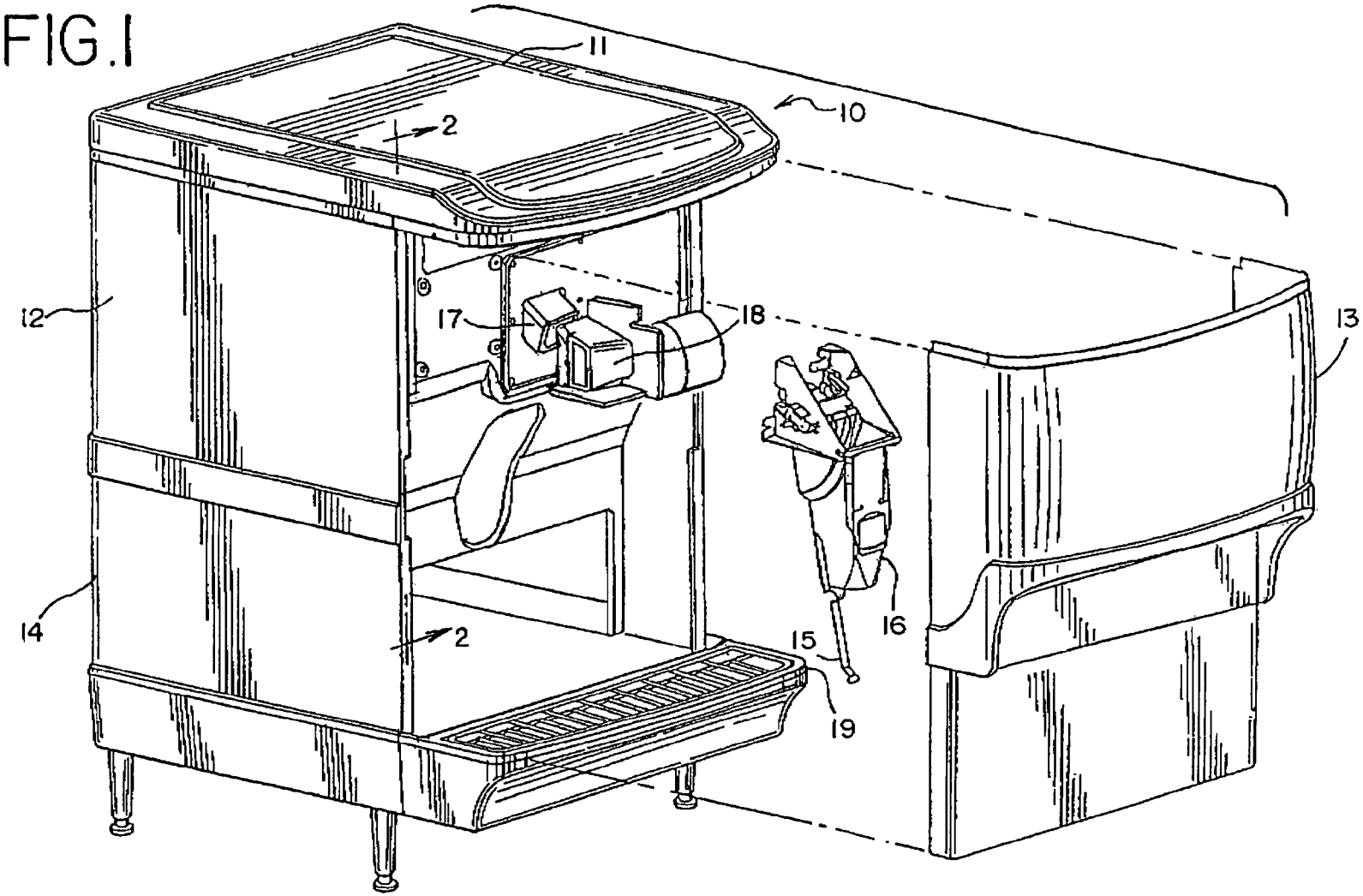
FIG. 1 is an exploded view of an embodiment of an ice dispenser with an integral ice crusher.

Ice crusher embodiments of the present invention may be used in ice dispensers and may also be used in beverage dispensers, particularly beverage dispensers that include an ice bin or an ice bin with an integral ice maker. FIG. 1 depicts an exploded view of an ice dispenser 10 with an ice crusher 18. Ice dispenser 10 includes a housing 14 and a housing cover 11, along with a front fascia 13. The ice dispenser includes an ice bin 12, and a downward sloping ice opening chute 17 that interfaces with the ice crusher 18. The ice crusher crushes and may hold ice in a small holding chamber until a user calls for ice by activating an actuator, such as the actuation lever 15. A controller (not shown) for the ice dispenser then opens an outlet door (not shown) to the ice holding chamber, and crushed ice tumbles from the holding chamber through ice chute 16 and into a cup or container held by the user. A drip pan or catch device 19 underneath the ice crusher or underneath the chute may collect melting ice particles and water droplets, as well as spills from overfilling of cups and move them toward a drain. For clarity, the usual ice-conveying paddlewheel inside the ice bin and the motor for driving the paddlewheel are not shown.

Figure 2:
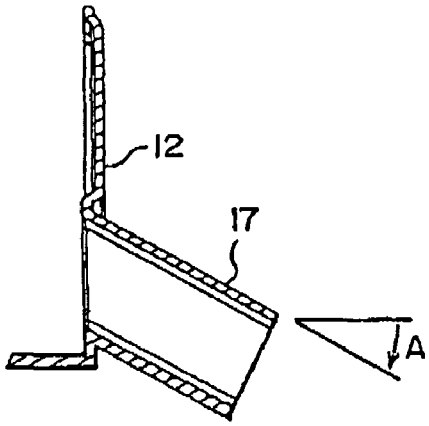
FIG. 2 is a cross-sectional view taken along line 2-2 of FIG. 1.
Figure 3:
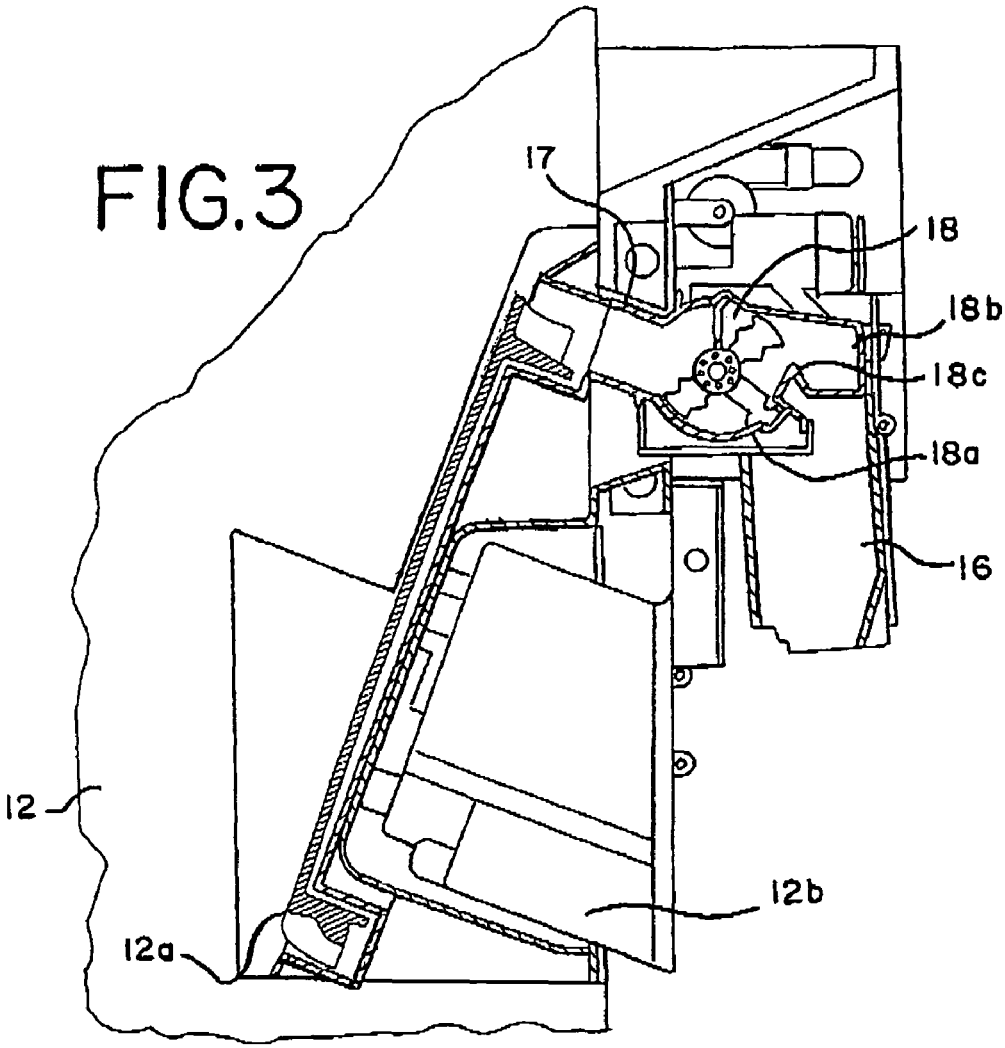
FIG. 3 is an elevation view, in partial cross section, of an ice bin with an integral ice crusher.
Figure 5A:
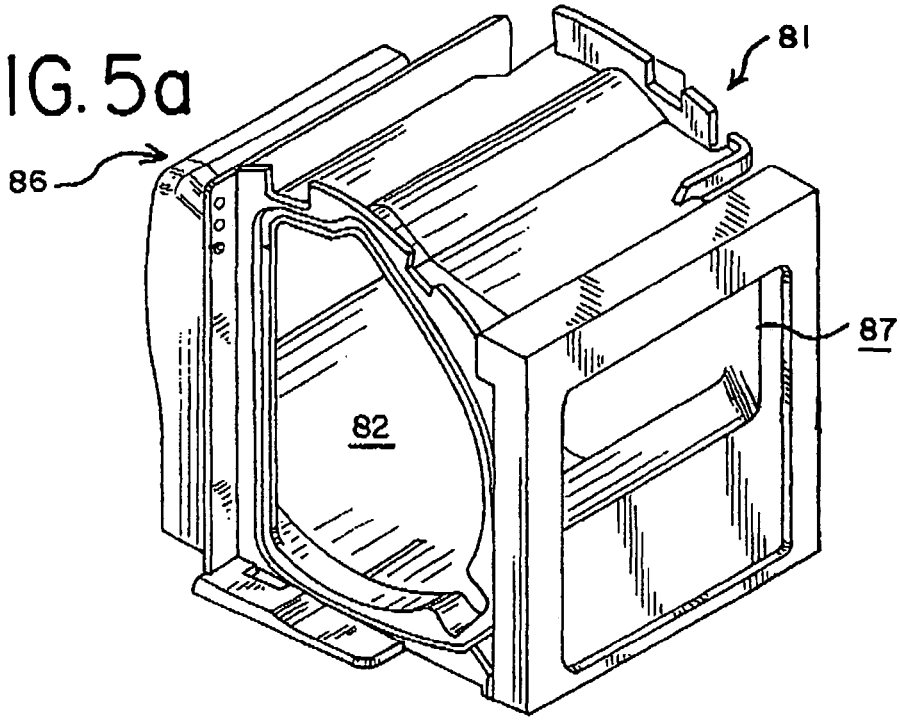
FIG. 5*a* is a perspective view of a second ice crusher embodiment.
Figure 5:
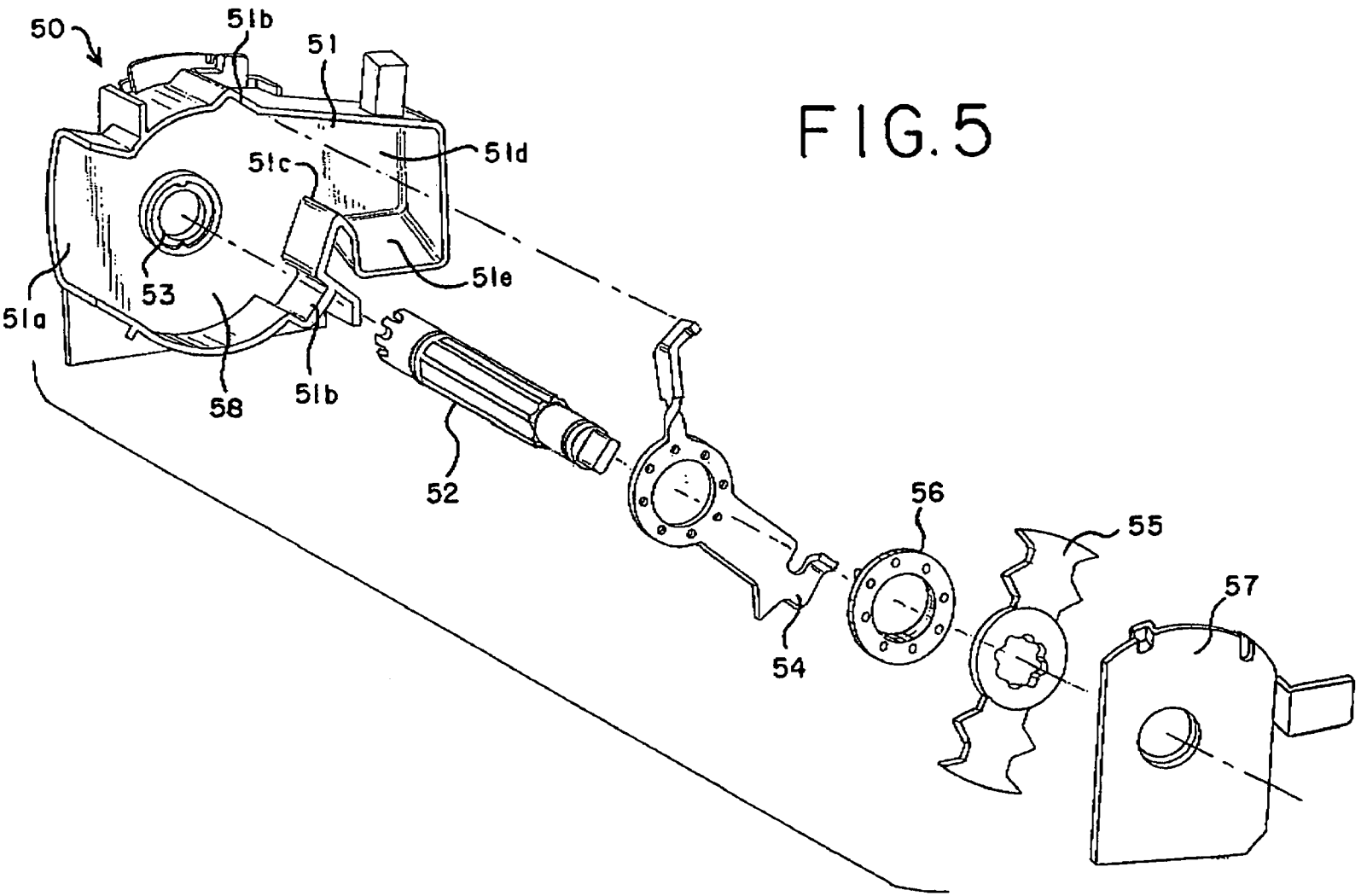
FIG. 5 is an exploded view of an ice crusher with a driven blade and a non-driven blade.

One unique aspect of the ice crusher helps to meet the area and height restrictions mentioned above. Because of these restrictions, it would be very helpful if the ice crusher could be inserted between the ice bin and the ice chute without requiring an increase in height of the ice dispenser, or a beverage dispenser when the ice crusher in included therewith. FIG. 2 is a cross-sectional elevational view of the interfaces between an ice bin 12 and an ice opening chute 17 in a dispenser for ice or in a combined ice and beverage dispenser. FIG. 3 is a partial cross-sectional elevational view showing the height relationships between an ice bin 12, an ice opening chute 17, and an ice crusher 18. The internal working parts of the ice crusher are shown in FIG. 5.

In FIG. 2, an ice opening chute 17 is assembled to an ice bin 12 at downward angle A. Angle A may be any suitable angle, but is preferably from about 10° to about 30°. This angle has been found to allow ice from the ice bin to quickly flow into the ice crusher. FIG. 3 depicts the height relationships between the component parts of the ice crusher 18 and ice opening chute 17 and ice bin 12. The ice resides in the ice bin 12, preferably atop a cold plate (not shown) for cooling water and syrup for beverages dispensed by a combined ice and beverage dispenser embodiment. Ice is conveyed from bin 12 to ice chute 17 by paddlewheel 12*a* driven by motor 12*b*. Ice enters the chute 17 and falls into the ice crusher 18 and working chamber 18*a*. The ice is crushed and is preferably, but not necessarily, conveyed upwardly to a holding chamber 18*b*. Holding chamber 18*b* is separated from the working chamber 18*a* by a wall 18*c* that, in preferred embodiments, requires the ice crusher to elevate the ice to at least as high of a level, and preferably a higher level, than the level at which the ice entered the ice crusher. Since the ice crusher lifts as well as crushes the ice, there is no need to raise the ice bin to a higher level or, alternately, to lower the outlet 16 for ice from the ice dispenser (see FIG. 1). The bottom of chamber 18*b* is preferably above the lowest point of ice opening chute 17, or the bottom of chamber 18*b* may be above some point of ice opening chute 17. The holding chamber need not be large. In one embodiment, the chamber holds about three ounces of crushed ice. This quantity is sufficient to allow ice to begin to flow almost at once when the user activates the ice actuator. In other embodiments, ice is crushed and conveyed so quickly that a holding chamber is not necessary.

As mentioned above, the ice crusher may be used in beverage dispensers as well as ice dispensers. An example of a beverage dispenser is depicted in FIG. 4. Beverage dispenser 20 includes housing 20*a* and top cover 20*b*. The front fascia has been removed for easier observation of the relevant internal portions of the beverage dispenser. Ice is held in ice bin 21, which interfaces through a downward sloping ice opening chute (not depicted in FIG. 4) to ice crusher 22. Ice crusher 22 is driven by motor 23 for crushing ice and delivering ice to a user via dispensing chute 24 when the user actuates ice dispensing. In this embodiment, the user has two options, crushed ice from ice crusher 22 or cubed ice. The user may select cubed ice by pressing switch 25*a*, or crushed ice by pressing switch 25*b*, and then begins dispensing the selected ice by pressing the dispensing chute 24. If cubed ice is selected, door 29 may be opened when the usual paddlewheel in ice-bin 21 is actuated, and ice is dispensed through door 29 and dispensing chute 24.

The beverage dispenser preferably includes at least one valve 26 (which will generally be a mixing and dispensing valve for mixing a syrup and water and dispensing a beverage, as is well known in the art), beverage dispensing actuator or lever 27, and dispensing nozzle 28. The beverage dispenser typically includes a cooling system, sources of water and carbonated water, and one or more beverages or beverage syrups. The user accesses a beverage through valve 26 and nozzle 28 by actuating an actuator 27 for dispensing a beverage.

The ice crusher used in either the ice crusher and dispenser 10 or the combined ice and beverage dispenser 20 is depicted in greater detail in an exploded isometric view in FIG. 5. The ice crusher is of relatively simple construction, and is preferably made with a nylon housing, stainless steel blades and wipers, and acetal bearings and bushings. The ice crusher 50 includes a housing 51, an aperture 53 for mounting a driven shaft 52, a working chamber 58 for housing the internal parts and in which the crushing takes place, and a removable door 57 so that the working parts and the internal portion of housing 51 may be cleaned. The outlet aperture and exit door or aperture for the ice is not shown in this view. Within the crushing chamber of the ice crusher are stationary blades 54 and rotating crusher blades 55, of which only one of each is shown. The stationary blades preferably alternate with the rotating blades. The rotating blades are driven by a motor and drive shaft (not shown) powering a driven shaft 52. One or more bearings or bushings 56 are provided to support the blades on the driven shaft 52 within the ice crusher.

A beverage dispenser with an ice crusher is depicted in FIG. 6. Beverage dispenser 30 includes an ice crusher 31 for crushing ice and also includes separate outlets 32*a*, 32*b* for dispensing ice from the ice dispenser: dispensing crushed ice from outlet 32*a*, and cubed ice from outlet 32*b*. Dispensers that dispense only ice and no beverage may also have separate outlets for cubed ice and for crushed ice. Beverage dispenser 30 also includes an additional chute 17 for dispensing cubed ice or other ice held in ice bin 12. The cubed ice is dispensed in cubed ice outlet 32*b*.

Ice bin 12 holds ice delivered either from an ice maker positioned above the ice bin or from another source, such as ice poured in by bucket. Ice crusher 31, which is the same as ice crusher 50 depicted in FIG. 5, is driven by a motor 31*a* powering a shaft 36 on which the rotating blades are mounted. In this embodiment, ice crusher 31 has a left side 33 which may be removed for cleaning, along with the internal components. The outlet door, which would normally seal ice outlet 34, has been removed in this view, which reveals a portion of the inside of the ice crusher. Internal wall 35 separates the working chamber 30*a* (toward the rear in this view) from the ice storage chamber 30*b* in the front. As mentioned above, the ice may be lifted from the working chamber in order to clear the internal wall and reach the storage chamber. Typical beverage dispensers also include at least one valve 37, at least one nozzle 38, and at least one actuator 39 for dispensing a beverage.

In the embodiment shown in FIG. 6, ice travels downward from ice bin 12 into ice crusher 31 and then outwardly to chamber 30*b*. Then, when the exit door (not shown) to the crushed ice chamber opens, the ice makes a 90° horizontal turn in order to exit and fall into the beverage cup of a user. In embodiments not requiring a storage chamber, there may be no reason for a 90° horizontal turn. In such embodiments, as shown in FIG. 5*a*, ice crusher 81 may simply have a gate or a door, such as a guillotine door (not shown), to an exit area 87 from crushing chamber 82. When the user activates a switch for crushed ice, the ice flows from bin 12 in the rear area 86 of crusher 81. At the same time, the crusher is actuated and crushes ice almost instantaneously, while the door opens and ice is dispensed quickly.

Figure 7:
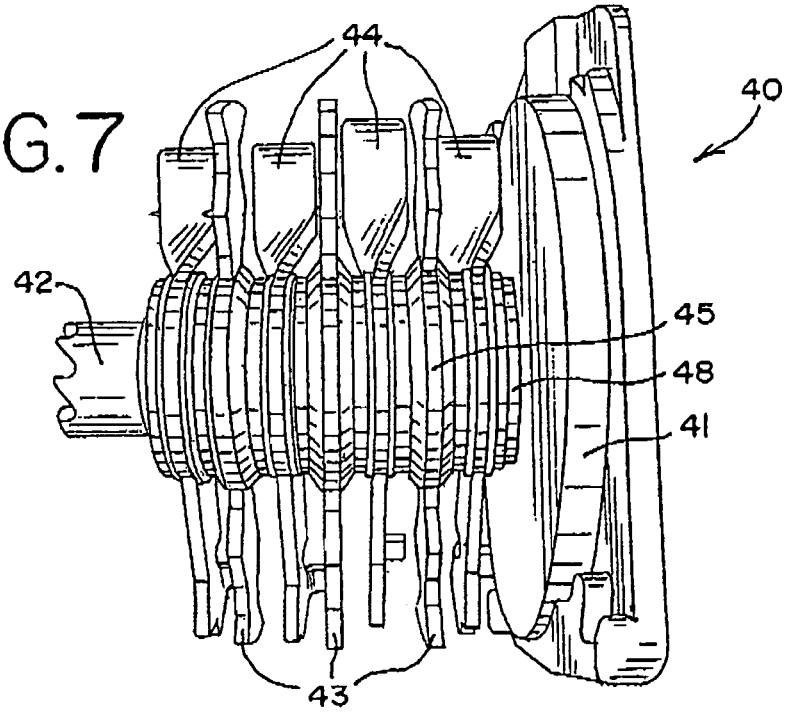
FIG. 7 is a plan view of the internal elements used in the ice crusher of FIG. 5.

The internal workings of the ice crusher are very important, because they need to be clean and sanitary as well as effective at crushing and conveying ice. The internal elements of ice crusher 40 mounted to removable left door 41 are depicted in FIG. 7. In this embodiment, the ice crusher interfaces through driven shaft 42 with the motor, located in the beverage dispenser or ice dispenser. Ice crusher 40 includes three internal rotating blades 43 alternating with four internal stationary blades 44. Each blade preferably has at least one bushing 45, 48 to minimize wear during rotation. The stationary blades are mounted on driven shaft 42, and as shown above, are not interfaced for being driven by drive shaft 42 and are prevented from rotating by the design of the ice crusher housing. In embodiments with a plurality of rotating/non-rotating blades, the blades are preferably assembled in an alternating manner, as shown in FIG. 7.

The wiper portion 44 on the non-driven blades will tend to wipe crushed ice from the rotating blades and cause the crushed ice to be transported through the outlet. Wiper portion 44 is bent at an angle of about 90° to the plane of the stationary blade, so that the wiper portion will fill most of the gap between adjacent rotating blades. A clearance of about 0.040-0.050 inches (about 1 mm) is recommended. If the ice crusher has a storage chamber and door, the ice will be stored before it is dispensed. If the ice crusher does not have an integral storage chamber and remotely-actuatable door, the ice will flow from the outlet of the crushing chamber to a dispensing means or storage volume as provided.

FIGS. 8-13 provide additional views of the internal components of the embodiment of the ice crusher depicted in FIG. 5. These components, and components very similar to them, may also be used in many of the other embodiments. A side view is presented in FIG. 8. As will be seen in FIGS. 9 and 10, the rotating blades 43 are mounted fixedly to the drive shaft 42 by a gear design on the inner periphery of the rotating blades and bushings 45 that matches the design on the outer periphery of shaft 42. When the shaft rotates, rotating blades 43 and bushings 45 rotate in tandem with the shaft. The bushings also act as vibration and sound dampening devices.

Figure 8:
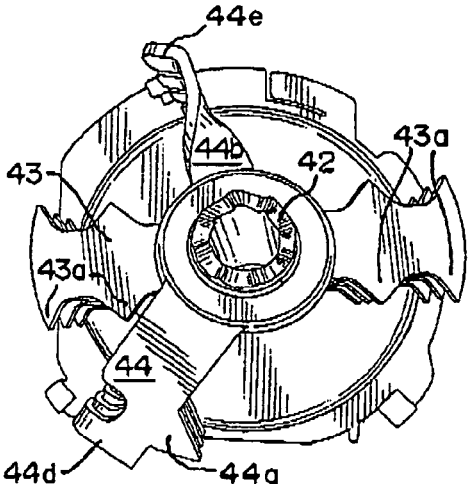
FIG. 8 is a side view of the internal elements used in the ice crusher of FIG. 5.

The drive shaft, in this embodiment, interfaces with a motor through dog-teeth on one end of the shaft. Rotating blades 43 are straight with a central hub and with cutting or crushing features such as teeth 43*a* on all four surfaces of each rotating blade. Non-rotating blades 44 preferably also have cutting or crushing features such as teeth 44*a* on at least one surface of the blade in this embodiment, although this feature is not necessary for their function of wiping and clearing ice from the crushing portion. The non-rotating blades also have a central hub and two portions, one portion on one side of the central hub with a cutting or crushing feature 44*a*, and another portion 44*b* at an angle of about 120°. Portion 44*b* includes a wiper 44*e* bent at about a 90° angle to a plane of non-rotating blade 44. In the orientation as seen in FIG. 8, the rotating blades rotate clockwise, so that ice is crushed by force generated between teeth features 43*a* on rotating blades 43 and teeth features 44*a* on non-rotating blades 44, and ice is wiped off the rotating blades and falls back downward away from wiper 44*e*.

Figure 9:
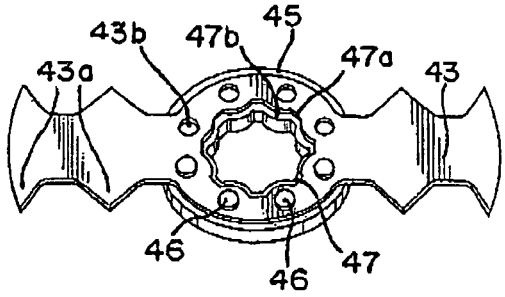
FIG. 9 is a side view of a rotating blade with an interface for a drive shaft used in the ice crusher of FIG. 5.
Figure 10:
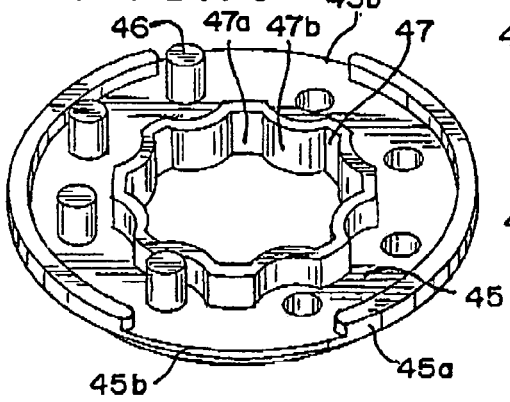
FIG. 10 is a perspective view of a bushing for a rotating blade with an interface for a drive shaft used in the ice crusher of FIG. 5.

The interface between rotating blade 43 and bushing 45 is depicted in FIGS. 9 and 10. Bushing 45, preferably made from acetal, includes an outer periphery 45*a* and notches 45*b* so that blade 43 can lay flat in the bushing. While acetal is preferred, any other food-grade material that is resistant to wear and erosion in sliding contact will suffice. These other materials include at least PTFE and nylon. The bushings also include bosses 46 that fit into apertures 43*b* in rotating blade 43. These bosses force bushing 45 to rotate with rotating blade 43. Bushing 45 also has a drive design on its inner periphery 47, including gaps 47*a* and raised portions 47*b* for interfacing with a drive shaft. Rotating blade 43 has a similar inner periphery of slightly larger diameter, so that bushing 45 can be assembled with rotating blade 43, and blade 43 and bushing 45 will rotate together.

Figure 11:
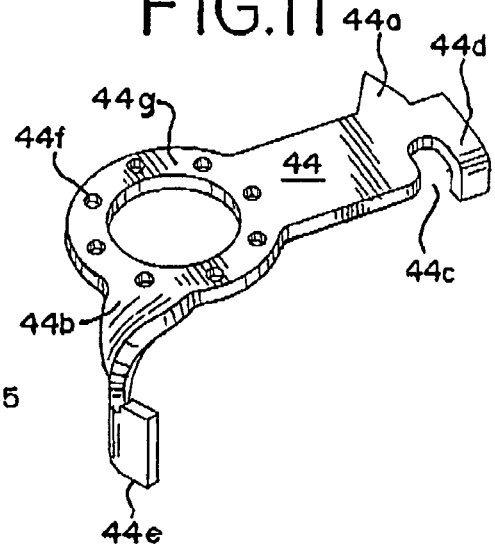
FIG. 11 is a perspective view of a non-rotating blade having a wiper element used in the ice crusher of FIG. 5.
Figure 12:
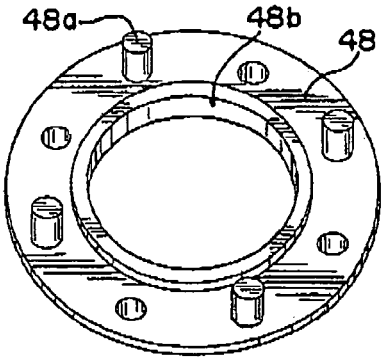
FIG. 12 is a perspective view of a bushing for a non-rotating blade used in the ice crusher of FIG. 5.

FIGS. 11-12 depict the non-rotating or stationary blade 44 and its bushing 48. Blade 44 preferably is made from stainless steel and has a first portion with tooth 44*a* for crushing or breaking ice and a retainer 44*d* for interfacing with the ice crusher housing. Relief 44*c* allows retainer 44*d* to fit into a groove in the housing. Blade 44 has a second portion 44*b* that is bent at about 90° to the plane of the blade so that wiper portion 44*e* can wipe away ice from between rotating blades 43 to provide a ready supply of crushed ice while allowing the blades to continue to rotate. The central area 44*g* has a plurality of apertures 44*f* for receiving bosses 48*a* from bushing 48. The bosses 48*a* are preferably in a different pattern from the pattern of rotating bushing 45, and the diameter of inner periphery 48*b* is preferably different and larger from the inner periphery of bushing 45, so that the bushings 45, 48 cannot be assembled with the incorrect blade. Bushings 48 function as bearings for non-rotating blades 44 on the outside of shaft 42 (FIG. 13), while bushings 45 are assembled with rotating blades 43, so that the blade 43 and bushing 45 assemblies interface with shaft 42.

Figure 13:
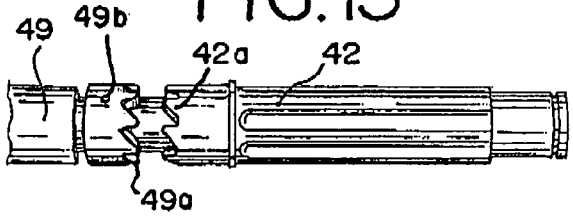
FIG. 13 is a plan view of a drive shaft and interface for the ice crusher of FIG. 5.

FIG. 13 depicts one embodiment of a shaft 42 for use in this embodiment. Shaft 42 is a driven shaft that interfaces by means of dog-teeth 42*a* to driving shaft 49 and dog teeth 49*a*. Dog-teeth 49*a* may be held by a pin 49*b* as shown.

Figure 14:
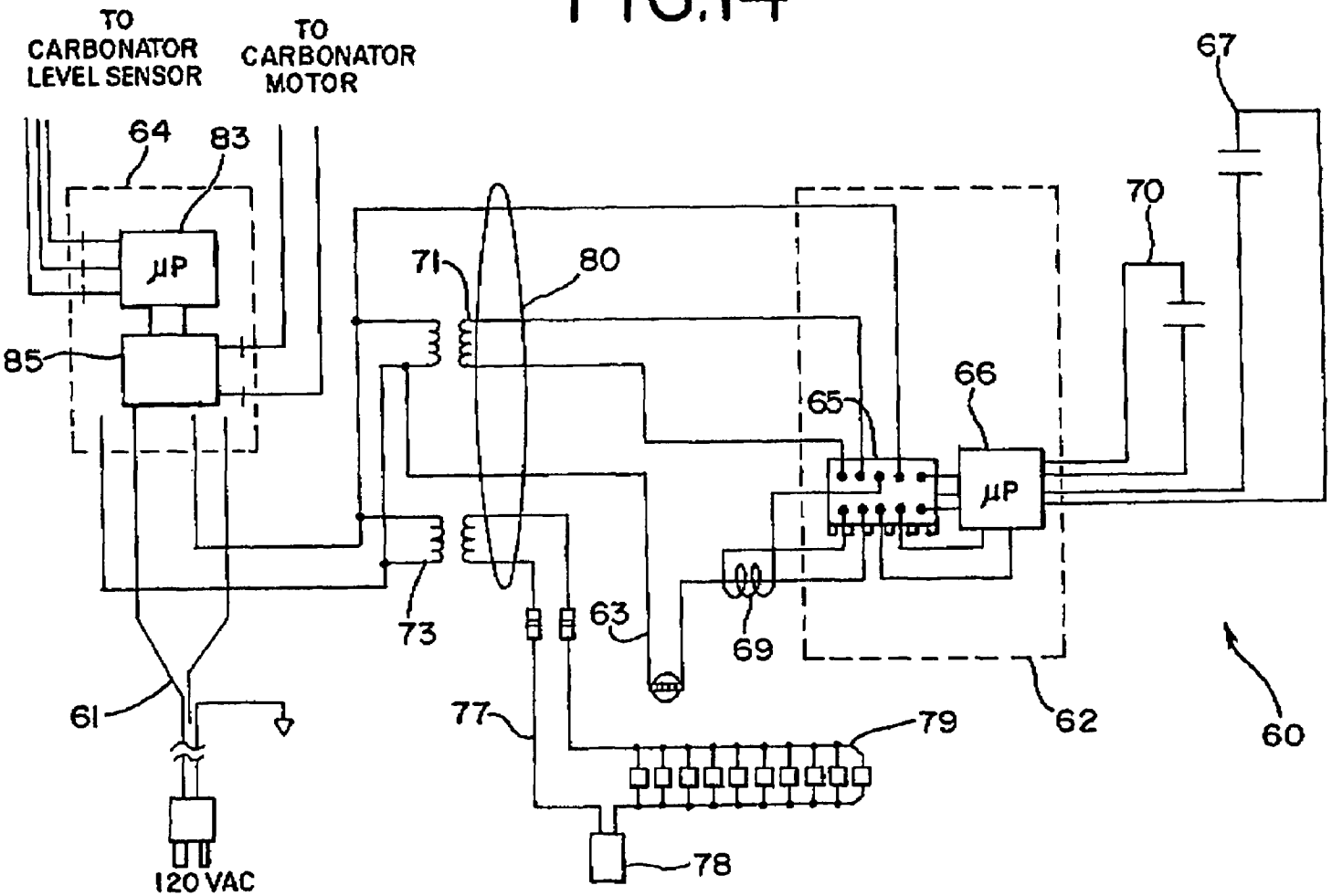
FIG. 14 is schematic diagram of an electrical system for an ice crusher and combined ice and beverage dispenser of FIG. 4.

FIG. 14 depicts an electrical system for an embodiment of an ice crusher and combined ice and beverage dispenser. The electrical system includes components for a combined ice and beverage dispenser with a carbonation system and an ice crusher. The electrical system 60 for this dispenser includes a power source 61, which may be single phase 120 VAC, or may be power of another voltage. In other embodiments, three-phase power may be used for the beverage dispenser or for the ice crusher, or for both.

The electrical system includes a first circuit board 62 and a carbonator circuit board 64. Circuit board 62 mounts mounting hardware or plugs 65 and a microprocessor controller 66 for controlling the drink dispenser with an integral ice crusher. The electrical system controls power to the soda valves and to the coils of ice crusher motor 63. Microprocessor controller 66 interfaces with safety switches and interlocks (not shown) on the dispenser. Interlocks may guard against removal of safety panels of a housing of the ice and beverage dispenser, by interrupting power to the ice and beverage dispenser if the panels are removed. Interlocks may also be placed on other components of the dispenser, including the ice crusher motor 63. A current transformer 69 may insure that ice crusher motor 63 is not overloaded by shutting down power to ice crusher motor 63 in case of an overload.

Ice dispensing switch 70, activated by an actuator for ice crusher motor 63, may interface with microprocessor controller 66 to begin crusher motor 63 when a user wishes to dispense ice, and afterwards to stop the crusher motor. Circuit board 62 may also mount transformers 71, 73, for providing stepped-down voltages to useful voltages, such as transformer 71 for providing 5V for control purposes and transformer 73 for providing 12V or 24VAC for beverage valves. Wiring harness 77 may provide 24V power to a conversion circuit 78 for powering solenoids 79 for solenoid valves or for the solenoid door for the ice crusher. Shielding 80 may be provided for power lines to and from transformers 71, 73. The shielding may be separated, such as for power harness 77 and for control circuitry, such as for the circuit board 62.

Circuit board 64 may contain controls for operating a carbonator for the ice and beverage dispenser. Included may be relay 85 for providing power to a carbonator motor pump. There may also be controls 83, such as a microprocessor, for receiving a signal from a carbonator lever sensor. Controls 83 may respond to a carbonator level sensor high and low level signals to supply or stop water to the carbonator. There may also be a circuit (not shown) for providing power and control for the typical paddlewheel type ice agitator within the ice bin, and its motor. The unit also has a safety switch, also known as a kill switch 67, to prevent operation if the cover is removed.

Figure 15:
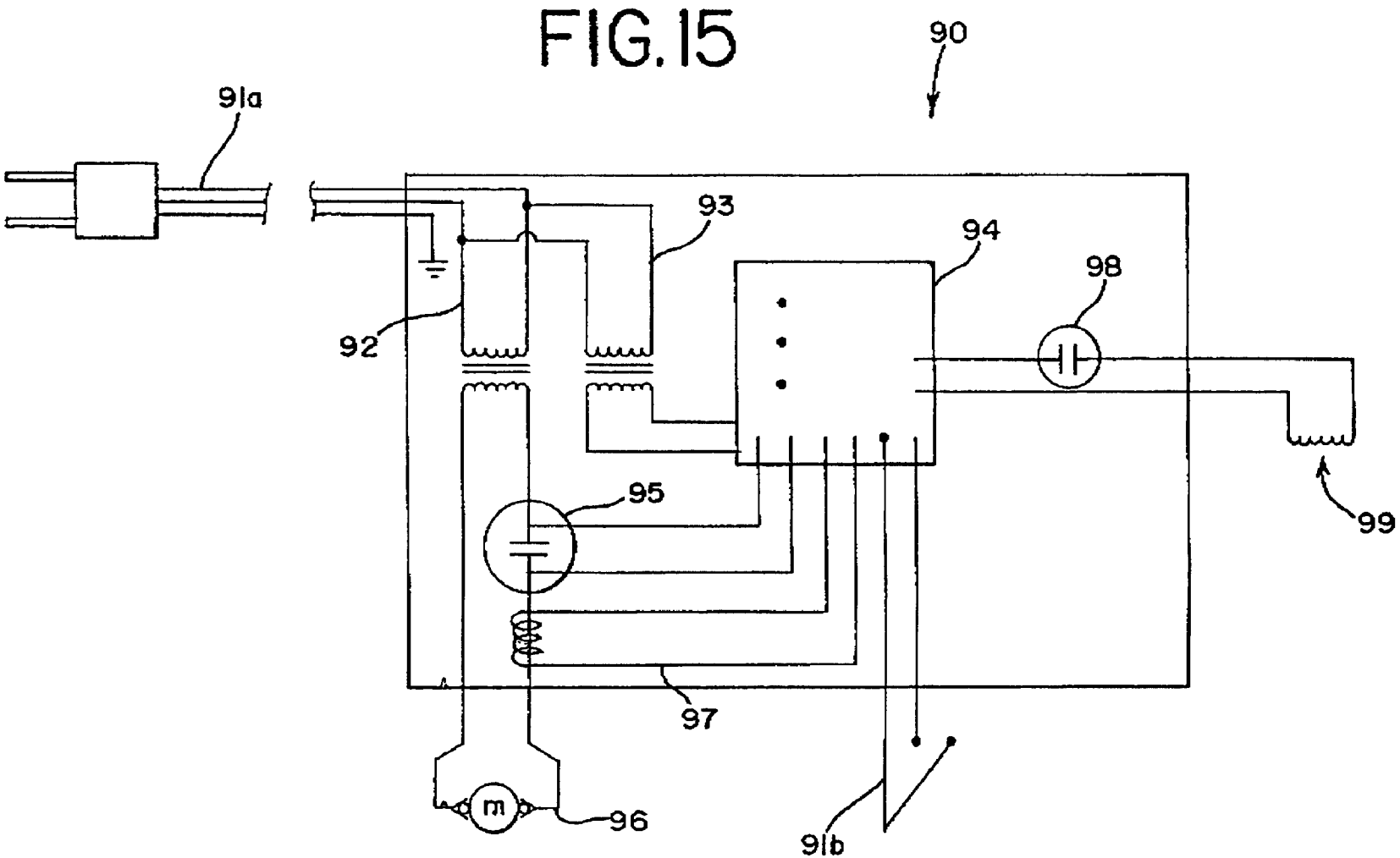
FIG. 15 is a schematic diagram of an electrical system for an embodiment of an ice crusher with an ice dispenser as used in the ice crusher of FIG. 1.

A simplified control system 90 for an embodiment of an ice dispenser with an ice crusher is depicted in FIG. 15. Control system 90 includes a power source 91*a*, transformers 92, 93 and a microprocessor controller 94. The transformers may include a first transformer 92, for stepping down input power to a voltage suitable for an ice crusher motor 96. Transformer 93 may be suitable for stepping down input power to a control voltage, such as 5 VDC, for operating microprocessor controller 94, and for relays and solenoids.

Control system 90 may also include controls for a switch or an actuator 91*b* for turning on the ice crusher. When the ice crusher is activated, relays 95 and 98 may activate for as long as actuator 91*b* is actuated, or for a specific period of time, such as for 3-20 seconds. Other periods of time may be programmed into the microprocessor controller. During operation, a current transformer 97 may be used to monitor the current drawn by the ice crusher motor. If the current is above a certain limit, controller 94 may be programmed to trip relay 95, thus cutting power to the motor. If this happens, the controller may also be programmed to trip relay 98, thus closing the solenoid door from the ice crusher to the ice chute down stream from the ice crusher, or the chamber which connects to the ice chute.

Figure 16:
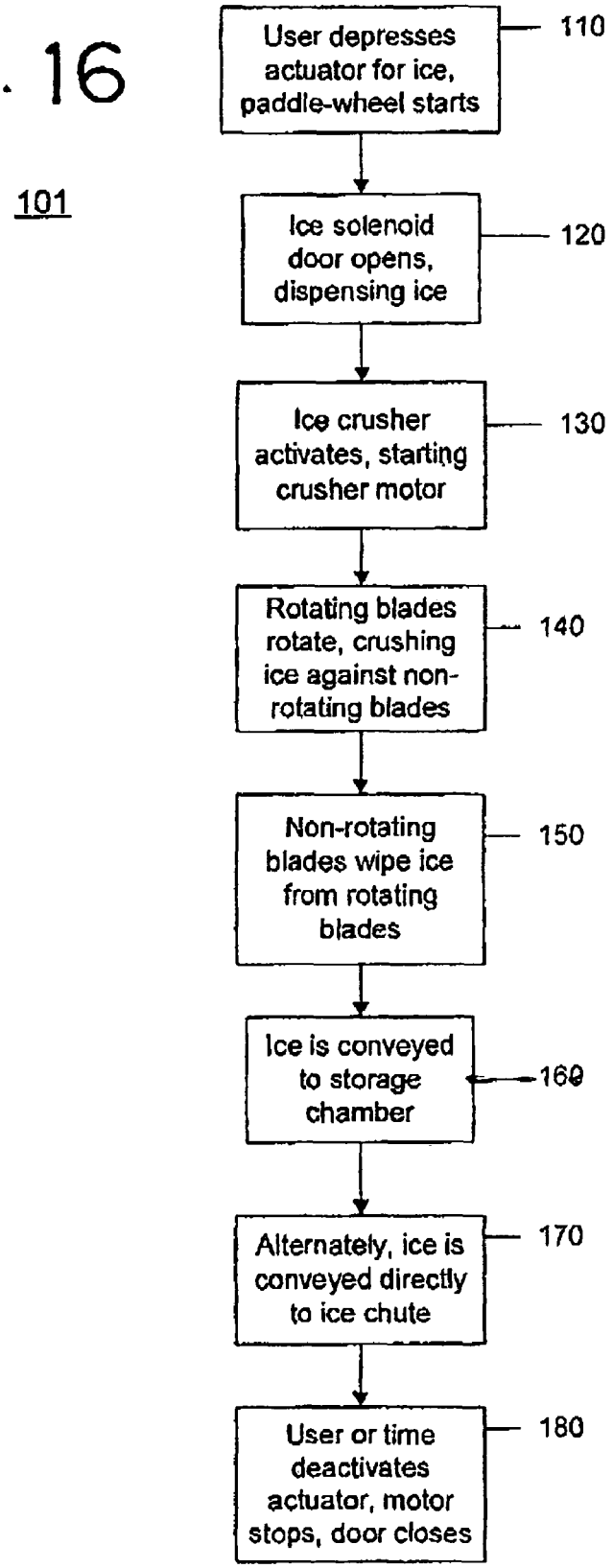
FIG. 16 is a flowchart depicting steps of a method of operating an ice crusher with an ice dispenser or an combined ice and beverage dispenser.

FIG. 16 is a flow chart for a method 101 of operating an ice crusher which is used in an ice dispenser or in a combined ice and beverage dispenser. In this method, a user depresses an actuator 110 in order to activate the ice or combined ice and beverage dispenser to dispense ice. Actuation also results in starting an agitator motor within the ice bin, such as a motor for a paddlewheel, thus bringing ice to the chutes within the ice bin, including the crushed ice chute. After actuation, the ice solenoid door opens 120, dispensing ice that remains if there is a holding chamber for a small amount of previously-crushed ice. Alternatively, as seen in the dispenser of FIGS. 18-22 and the dispenser of FIG. 23-26, the door can be on the outlet of the ice crusher. The ice crusher also activates 130, starting the ice crusher motor. The rotating blades of the ice crusher rotate 140, crushing ice against the non-rotating blades. The non-rotating blades wipe 150 ice from the rotating blades. By this action of the rotating and non-rotating blades, ice is conveyed 160 to a chamber down-stream of the crushing chamber. Alternately, ice is conveyed 170 out of the ice crusher to an ice chute. The ice crusher then stops 180, either deactivated by the user ceasing to depress an actuating button or pad, or ceasing to push on an actuating lever. Alternatively or additionally, the ice crusher may be programmed to cease after a specified period of time. The exit door, preferably a solenoid-operated door, then closes, and the ice crusher/dispenser is ready for the next user.

The ice bin and beverage dispenser embodiments preferably do not depend on mechanical refrigeration, except, as discussed above, embodiments that include an integral ice maker. The term mechanical refrigeration includes machinery, such as electrically-powered or gas-powered refrigeration systems, but does not include a quantity of ice without such machinery. The term "non-refrigerated ice bin" therefore refers to an ice bin that is not inside of a refrigerated space, such as the ice bins depicted herein, wherein the ice melts over time and has to be replenished. By way of contrast, an ice bin inside of a freezer compartment of a home refrigerator/freezer appliance is a refrigerated ice bin.

Figure 17:
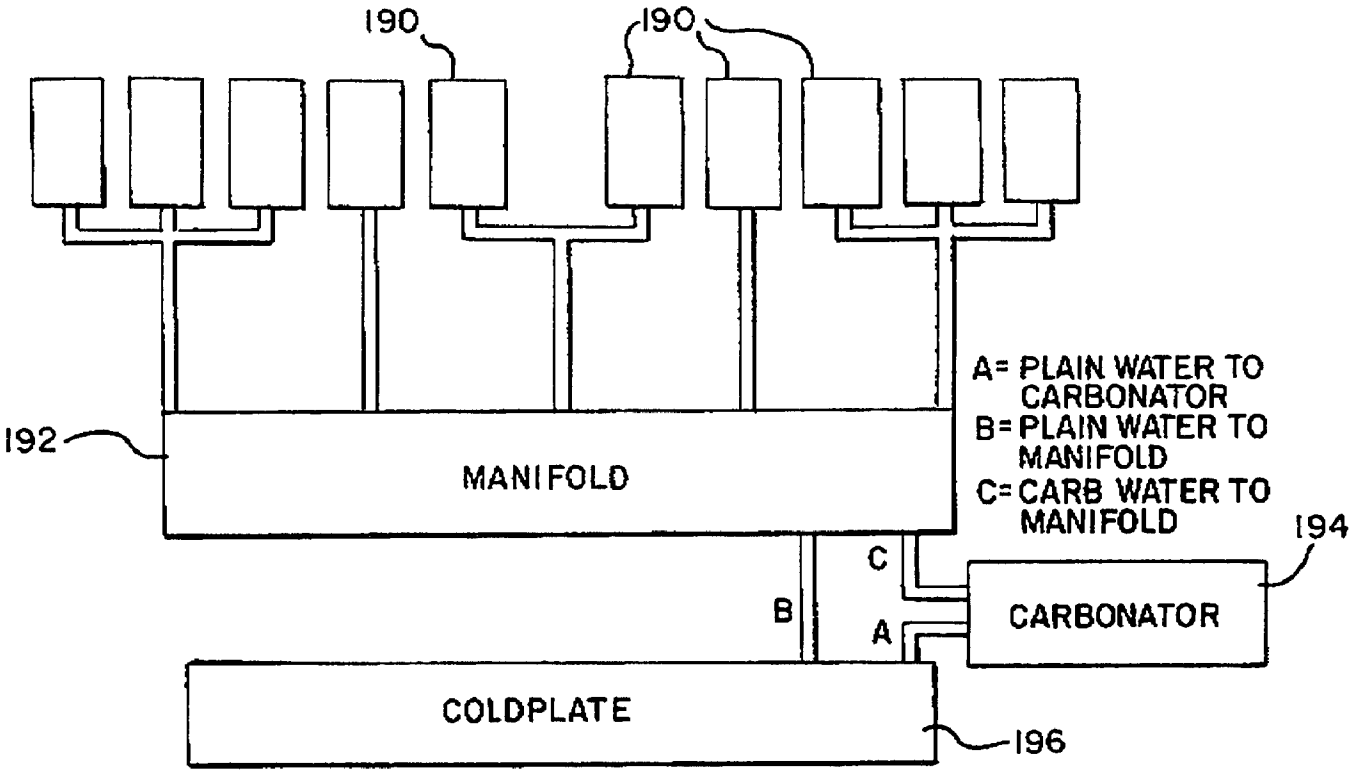
FIG. 17 is a schematic diagram of the water system of a beverage dispenser with a cold plate heat exchanger.

FIG. 17 depicts portions of the beverage system in a combination ice and beverage dispenser. The beverage system may be the same as beverage systems currently used in beverage dispensers, and is therefore not discussed in detail. In the depicted embodiment, there are ten mixing and dispensing valves 190. The number of valves may vary from one model of equipment to another. In the ice and beverage dispenser having twenty mixing and dispensing valves, two separate systems like that of FIG. 17 will be used in one machine. A water manifold 192 is used to supply carbonated or non-carbonated water to the valves 190. Non-carbonated water is used to provide a non-carbonated "water only" beverage through one or more of the valves 190. One such manifold is depicted in U.S. Pat. No. 6,698,621, incorporated herein by reference. In this embodiment, water is supplied to and cooled by cold plate 196. The cold plate typically sits at the bottom of the ice bin, and is cooled by the same ice that is dispensed from, or fed to the crusher, from the ice bin. Plain water is fed from the cold plate to both a carbonator 194 and the manifold 192. A carbon dioxide line (not shown) provides carbon dioxide to the carbonator 194. Carbonated water is then fed to the manifold 192. Cold plate heat exchanger 196 is preferably made by casting aluminum around one or more coils for cooling water or syrup. Other details of a typical beverage system, such as a carbonator pump, water lines, syrup lines and the like, are depicted in U.S. Pat. No. 6,761,036, which is also incorporated herein by reference.

FIGS. 18-22 depict a preferred embodiment of a combined ice and beverage dispenser 210. The dispenser 210 is very similar to dispenser 20 of FIG. 4, but includes several significant modifications. First, in this embodiment the opening out of the ice bin to the ice crusher 250 is always open. However, ice cubes will not pass through the ice crusher unless the door out of the ice crusher is open and the crusher is activated. Second, there is no holding chamber for crushed ice.

Figure 18:
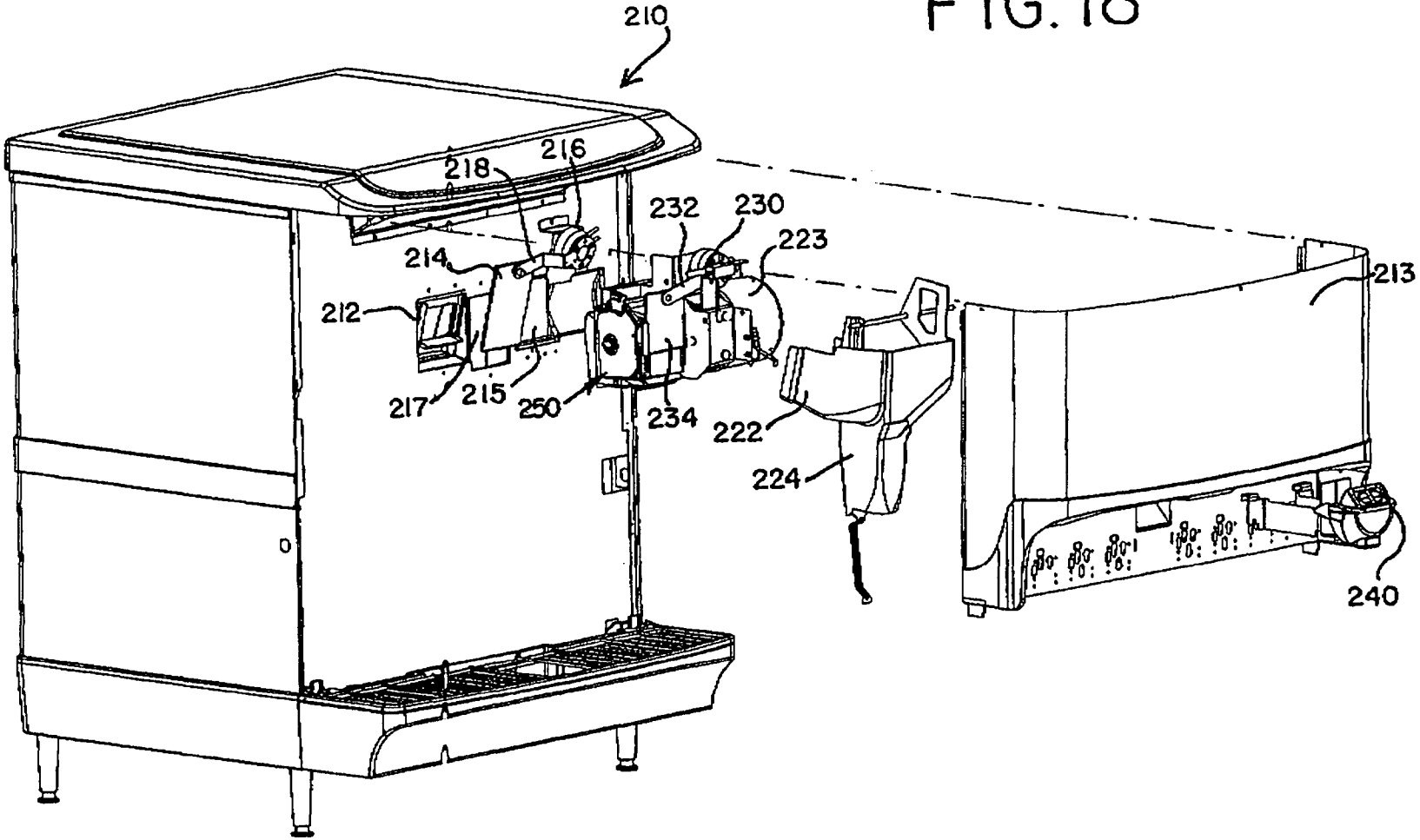
FIG. 18 is a partial exploded view of another embodiment of a combined ice and beverage dispenser, having a single dispensing chute for both cubed and crushed ice.
Figure 19:
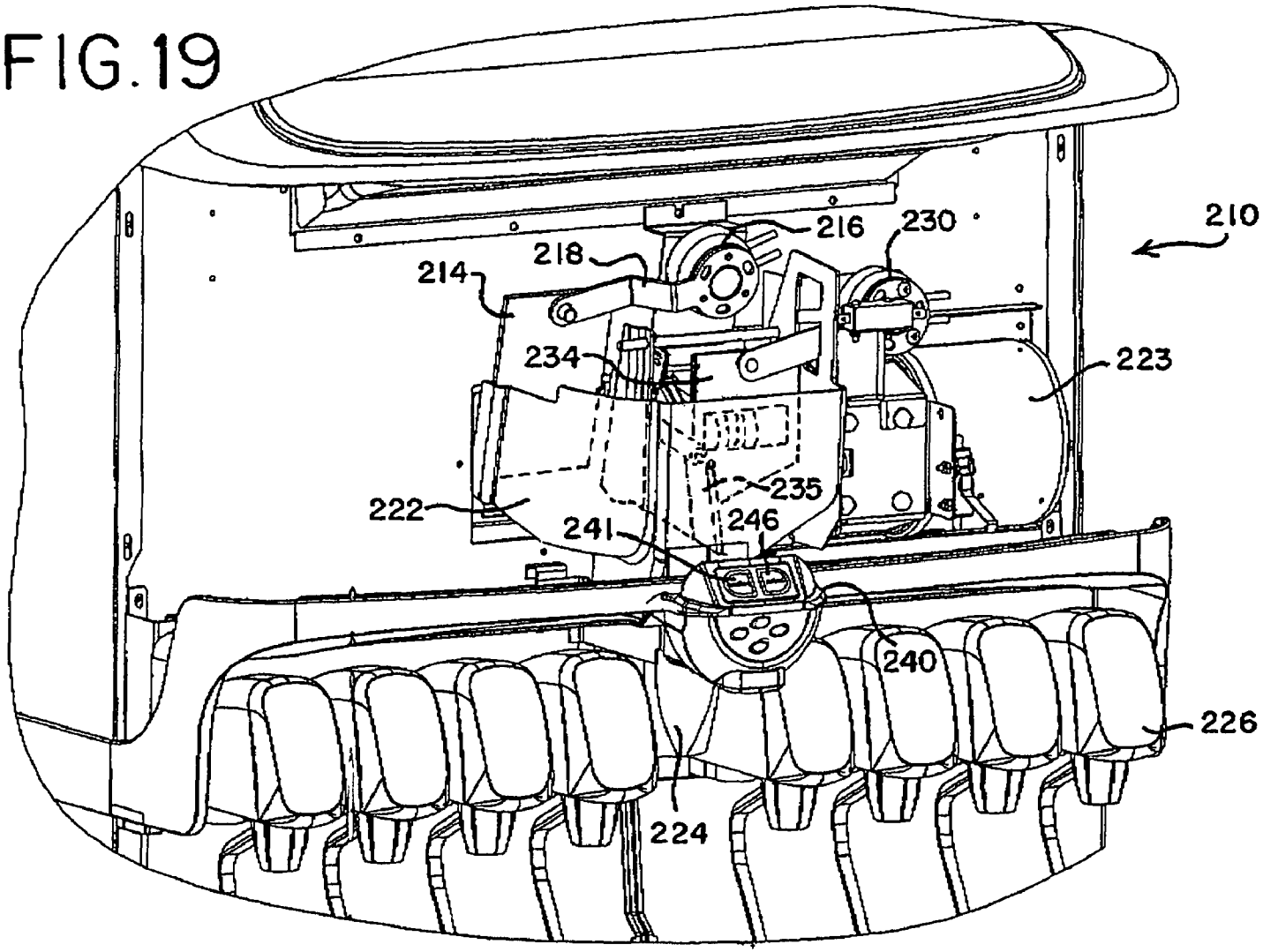
FIG. 19 is an enlarged perspective view of a portion of the combined ice and beverage dispenser of FIG. 18.

As shown in FIG. 18, a front fascia 213 normally covers the ice crusher and motor. The beverage mixing and dispensing valves 226 have been left out of FIG. 18 for clarity, but are shown in FIG. 19, where the fascia 213 is not shown for clarity. There are two openings out of the ice bin, opening 212 for cubed ice, and opening 217, which feeds into the ice crusher housing. Also seen in FIG. 18 is a recess 215 that allows the ice crusher and motor components to be set back, reducing the amount that they protrude from the front of the machine. Opening 212 is normally closed by door 214, which is operated by lever arm 218 connected to rotary solenoid 216. The door 214 slides up and down in tracks provided in the opening 212, which are at a slight angle from vertical. When door 214 is open and the paddlewheel inside the ice bin is rotating, ice cubes pass through opening 212 into collector 222 which is formed on the top of dispensing chute 224. The ice crusher housing has an outlet normally covered by door 234, which is operated by lever 232 connected to rotary solenoid 230. A safety guard 235 (best seen in FIG. 19) is mounted on a rod inside of collector 222. The guard is pivotally mounted so that its bottom can swing away from the ice crusher, allowing crushed ice to pass into the dispensing chute 224. However, the guard can only swing back to the vertical position, where it stops, which prevents someone from sticking a finger up into the chute and getting it in contact with the internal crusher elements.

Figure 20:
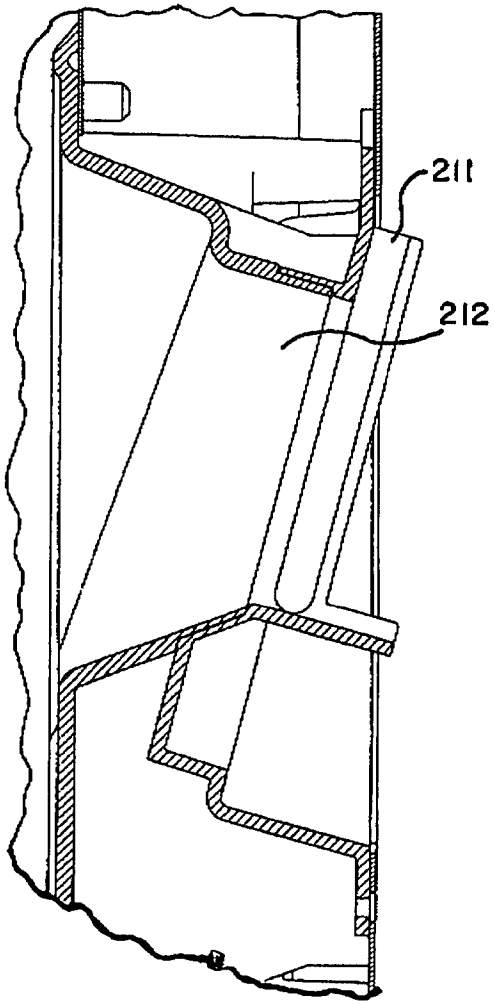
FIG. 20 is a vertical cross-sectional view through the cubed ice outlet on the combined ice and beverage dispenser of FIG. 18.
Figure 24:
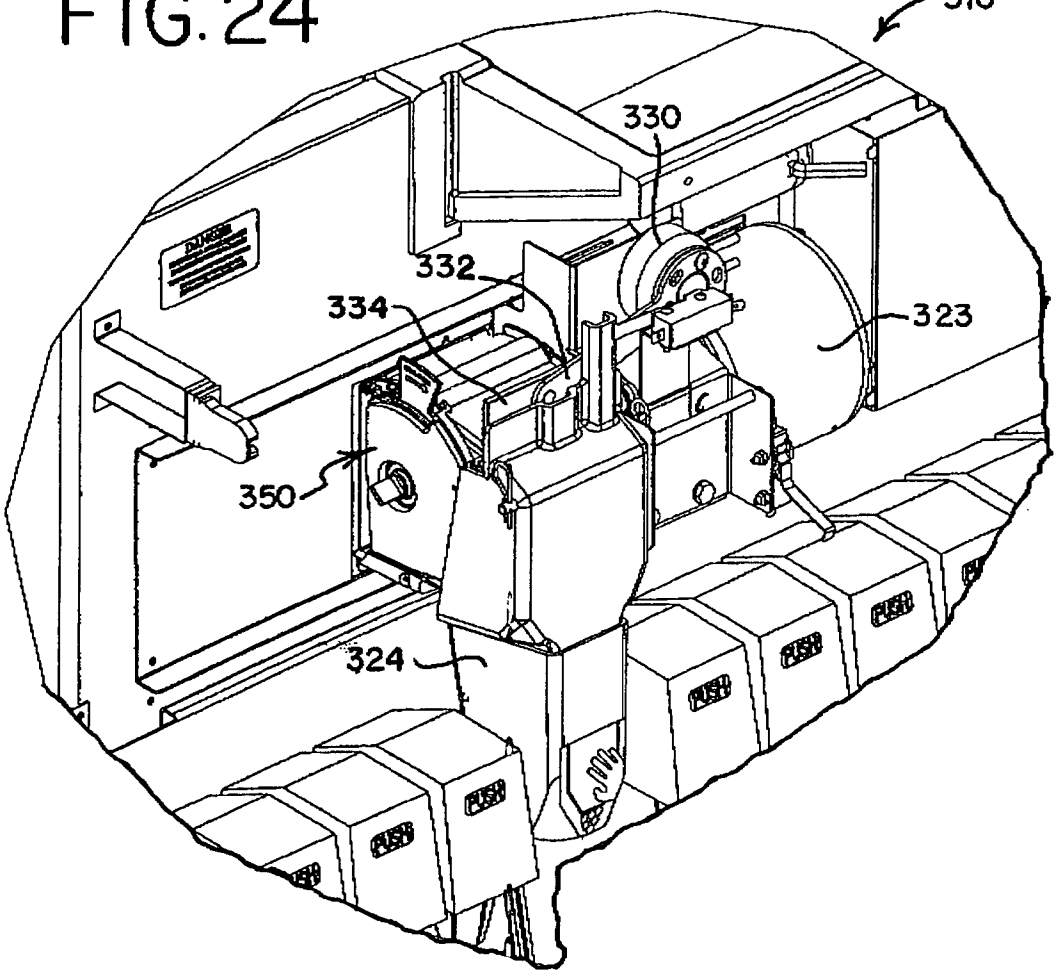
FIG. 24 is an enlarged perspective view of the left-hand portion of the combined ice and beverage dispenser of FIG. 23.

FIG. 20 shows a cross-sectional view of the cubed ice outlet for dispenser 210. In this view, the slot 211 in which door 214 slides can be easily seen. (The door 214 is not shown in this view for sake of clarity.) As noted earlier, this slot is at a slight angle from vertical.

Figure 21:
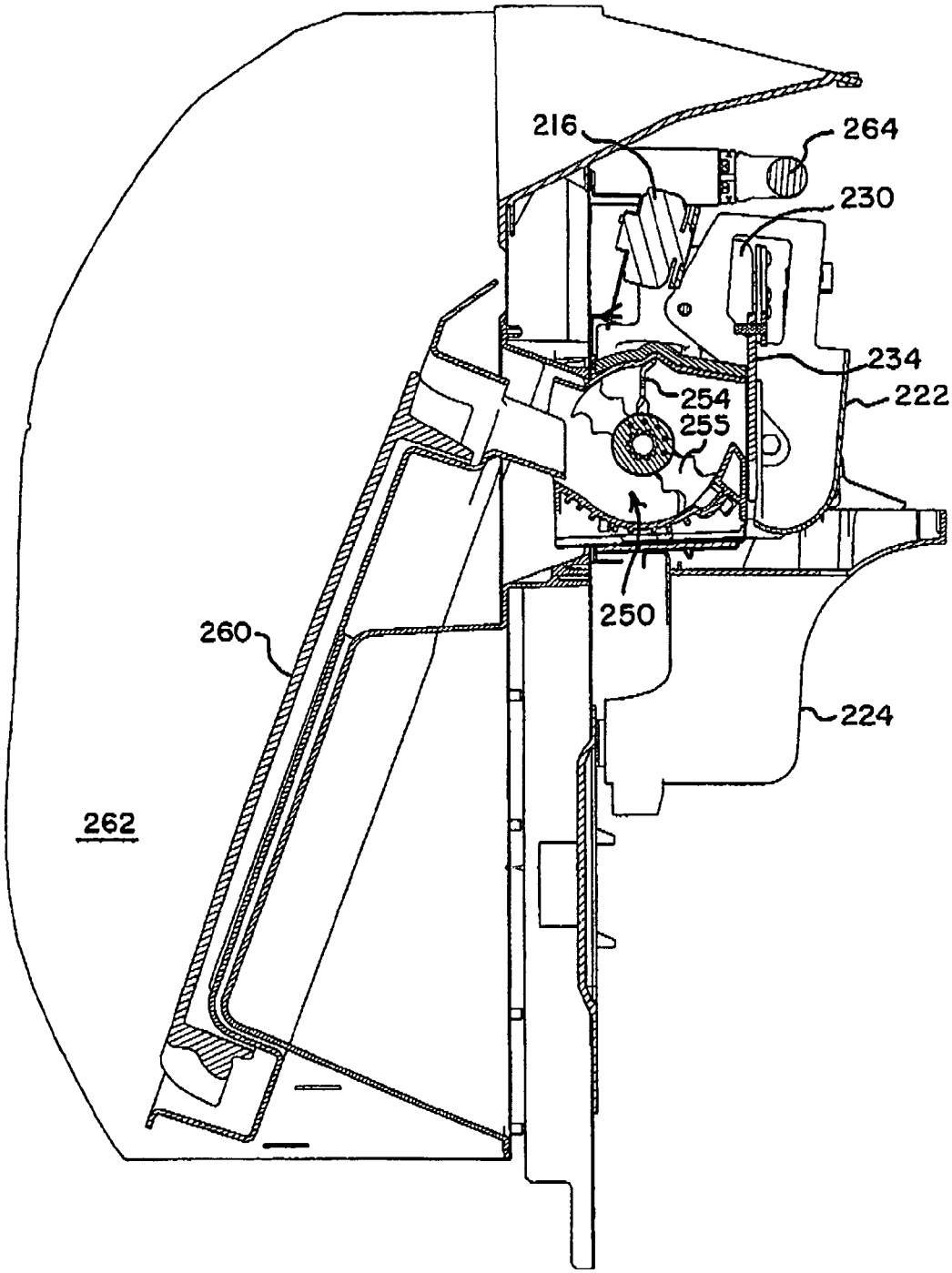
FIG. 21 is a vertical cross-sectional view through the ice crusher and crushed ice outlet on the combined ice and beverage dispenser of FIG. 18.

FIG. 21 shows a cross-sectional view of the crushed ice outlet and ice crusher for dispenser 210. This view also shows the paddlewheel 260 used to lift ice within the ice bin 262 of dispenser 210. The cross-section is slightly to the right of center through the paddlewheel.

Cubed ice is delivered to ice crusher 250 through a downward sloping chute. Rotating crusher blades 255 turn counterclockwise in the view of FIG. 21, crushing the ice cubes against stationary blades 254 at about the 5 O'clock position. The crushed ice is then carried up inside the crusher housing until it spills over through the crusher housing outlet when door 234 is lifted by rotary solenoid 230. As can be seen from FIG. 21, the crushed ice outlet is not at the bottom of the housing, but rather is positioned in the housing such that the bottom of the crushed ice outlet is at an elevation at least as high as the bottom of the inlet. The drive shaft for the rotating blades 255 is mounted with a horizontal axis of rotation in the housing, and the crushed ice outlet is positioned such that the top of the outlet opening is above a horizontal plane through the shaft axis of rotation. Any crushed ice that stays on rotating blades 255 is wiped off by the wipers on stationary blades 254. As seen in FIG. 21, the wipers are positioned within the housing such that crushed ice sticking to the rotating blades 255 is carried past the crushed ice outlet by the rotating blades and then deflected off the wipers and out the crushed ice outlet. Particularly the wiper portions of stationary blades 254 are in the top half of the housing. FIG. 21 also shows the location of merchandiser light 264.

A keypad selector 240 (FIG. 19) is used to select whether cubed or crushed ice is to be dispensed. If button 241 is pushed, crushed ice will be dispensed when the dispensing chute 224 is pushed backward. If button 246 is pressed, then cubed ice will be dispensed when dispensing chute 224 is pushed.

Figure 22:
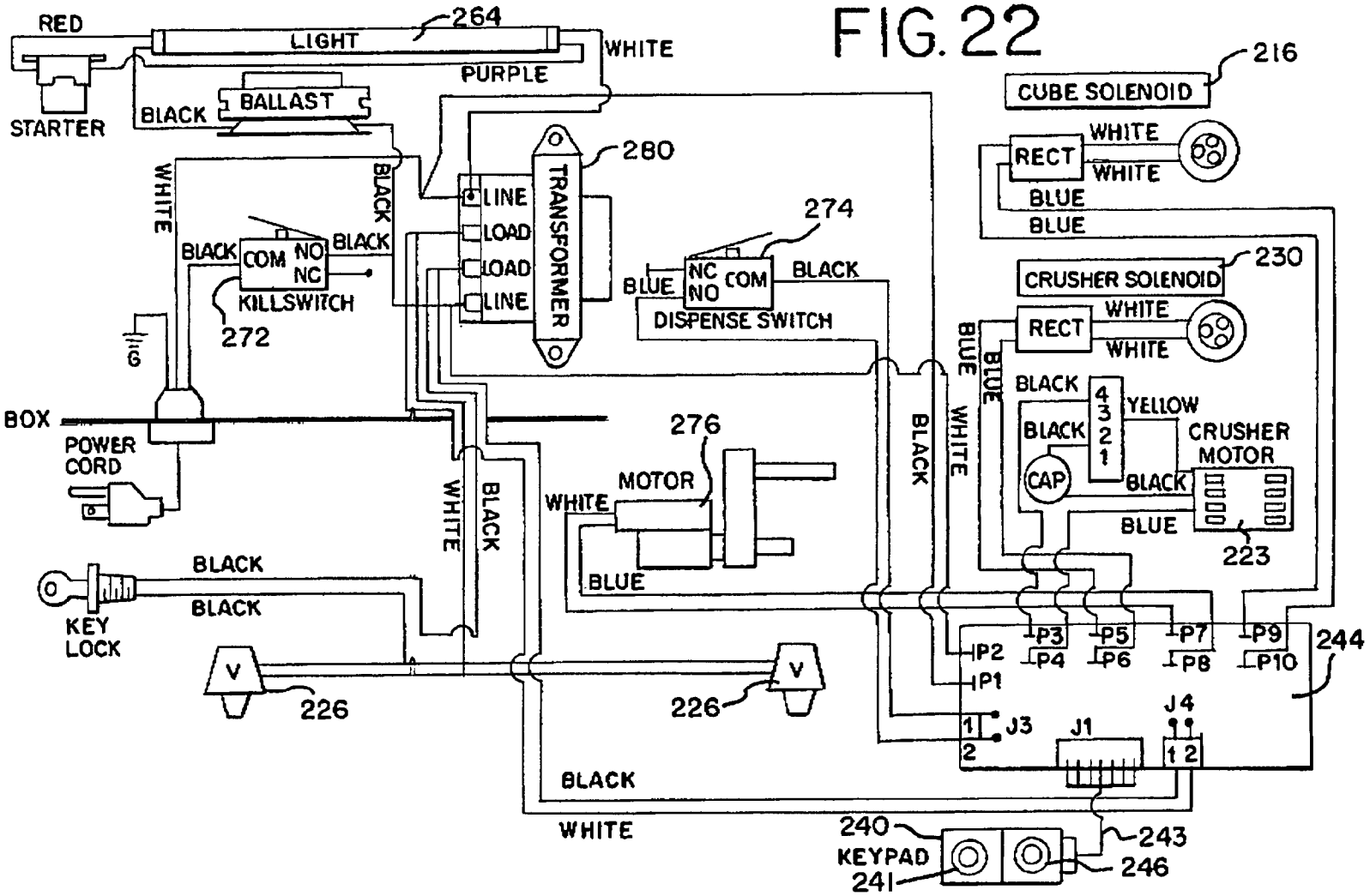
FIG. 22 is a schematic diagram of an electrical system for the combined ice and beverage dispenser of FIG. 18.
Figure 23:
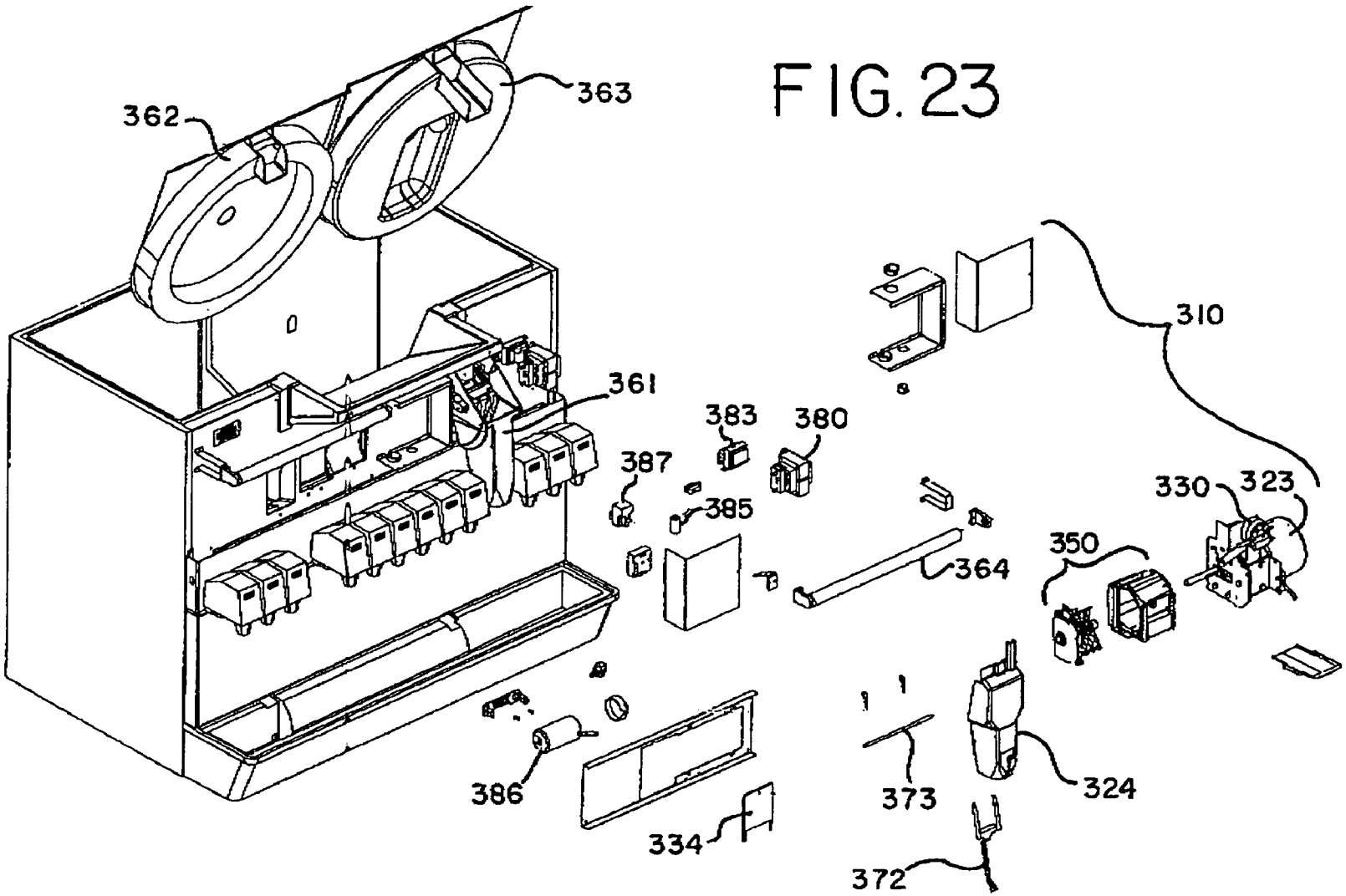
FIG. 23 is an exploded view of another embodiment of a combined ice and beverage dispenser, having separate dispensing chutes for cubed and crushed ice.

The control of the rotary solenoids 216 and 230, and the crusher motor 223, as well as other electrical components, is performed using an electrical system, the schematic of which is depicted in FIG. 22. Circuit board 244 includes terminals for several circuits, as well as a microprocessor controller. For example, P1 and P2 connect to line voltage power. The wires leading to a rectifier supplying power to rotary solenoid 216 used to control the dispensing of cubed ice connect to the circuit board 244 at P9 and P10. Likewise, wires to the rectifier supplying power to rotary solenoid 230 used to open the door 234 leading out of the ice crusher 250 connect at P5 and P6. Crusher motor and its associated capacitor connect through P3 and P4. Keypad 240, containing selector pushbuttons 241 and 246 for selecting crushed or cubed ice, connect to the circuit board 244 through a ribbon cable 243 having a polarized plug at J1. Reduced voltage power for operating mixing and dispensing valves 226 (the control circuitry of which is standard and therefore not shown) is provided by transformer 280, which also supplies low voltage power to circuit board 244 at J4. The schematic also shows power being supplied to fluorescent light 264 and its associated ballast and starter. The dispenser 210 is equipped with a kill switch 272 which shuts down power to the machine when the front cover is removed. Dispense switch 274, connected to circuit board 244 at J3, is activated when the dispensing chute 224 is pushed. The motor 276, connected to the circuit board through P7 and P8, operates the paddlewheel. The control system is set up such that when the dispense switch 274 is activated, motor 276 rotates, and the microprocessor looks to see which of pushbuttons 241 and 246 was last pressed. If pushbutton 241 was last pressed, the crusher motor 223 and crusher solenoid 230 are activated simultaneously, causing the crusher to operate and opening door 234 adjacent the crushed ice outlet. If pushbutton 246 was last activated, the cubed ice solenoid 216 is activated, opening door 212.

Ice and beverage dispenser 310 of FIGS. 23-26 has separate cubed ice and crushed ice dispensing chutes, like dispenser 30 of FIG. 6, but includes several significant modifications, many of which are similar to features on dispenser 210 of FIGS. 18-22. As with FIG. 19, the front fascia is not shown for dispenser 310. The dispenser 310 is shown with two paddlewheel areas 362 and 363. These paddlewheel areas each contain a paddlewheel, one for supplying ice to the ice crusher, and one for supplying ice to the cubed iced dispensing chute.

The cubed ice dispensing chute 361 is located on the right side of dispenser 310. The flow of cubed ice through the outlet from the ice bin is controlled by pushing cubed ice dispensing chute 361. The connection of dispensing chute 361 to the dispenser 310, and the control of ice cubes through the chute, may be the same as the cubed ice dispensing mechanism on a conventional ice and beverage dispenser that only dispenses cubed ice, or it may include a rotary solenoid and a door like the solenoid 216 and door 214 of dispenser 210.

Figure 25:
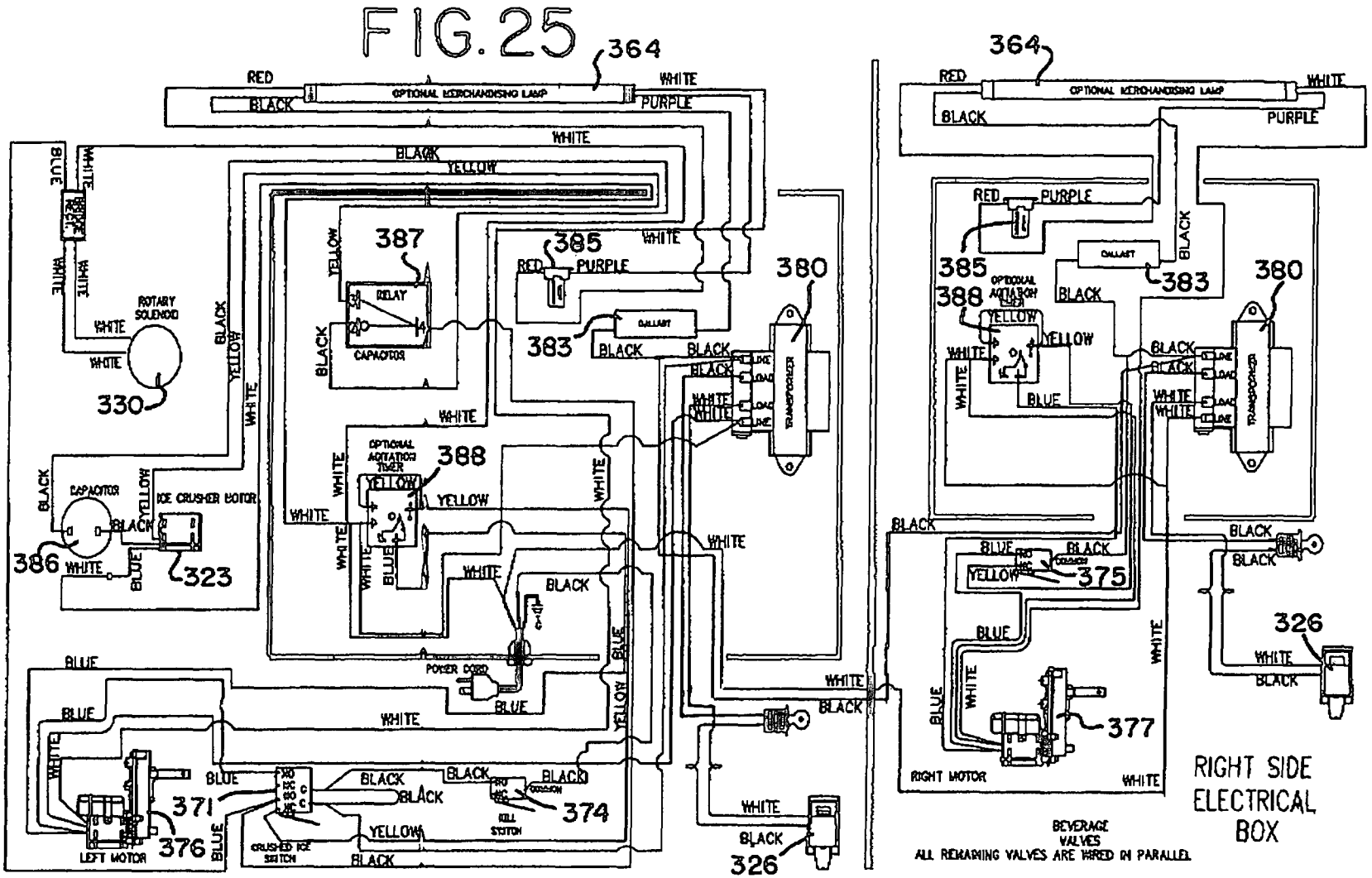
FIG. 25 is a schematic diagram of an electrical system for the combined ice and beverage dispenser of FIG. 23.
Figure 26:
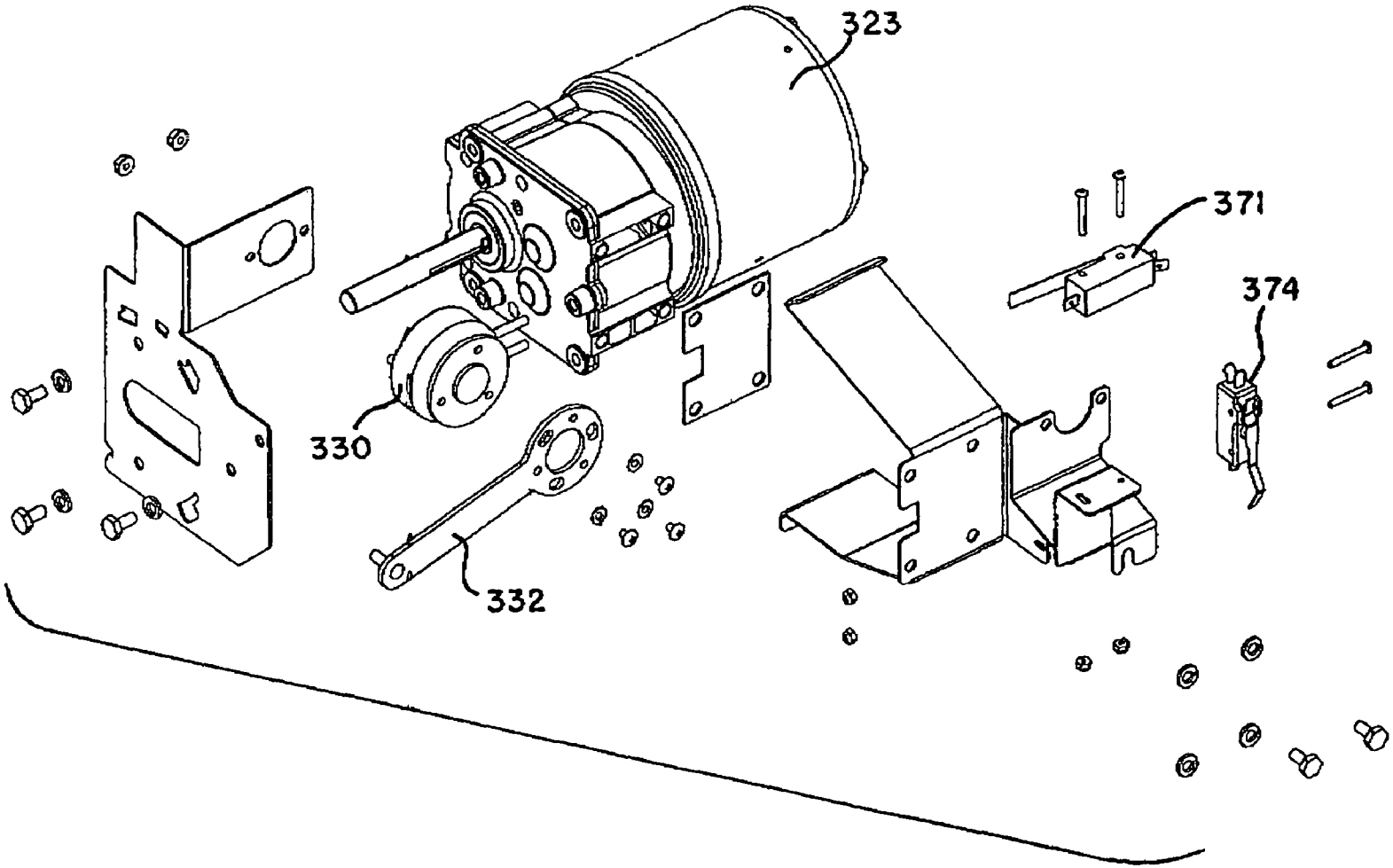
FIG. 26 is an exploded view of the motor and rotary solenoid for the ice crusher on the combined ice and beverage dispenser of FIG. 23.
Figure 27:
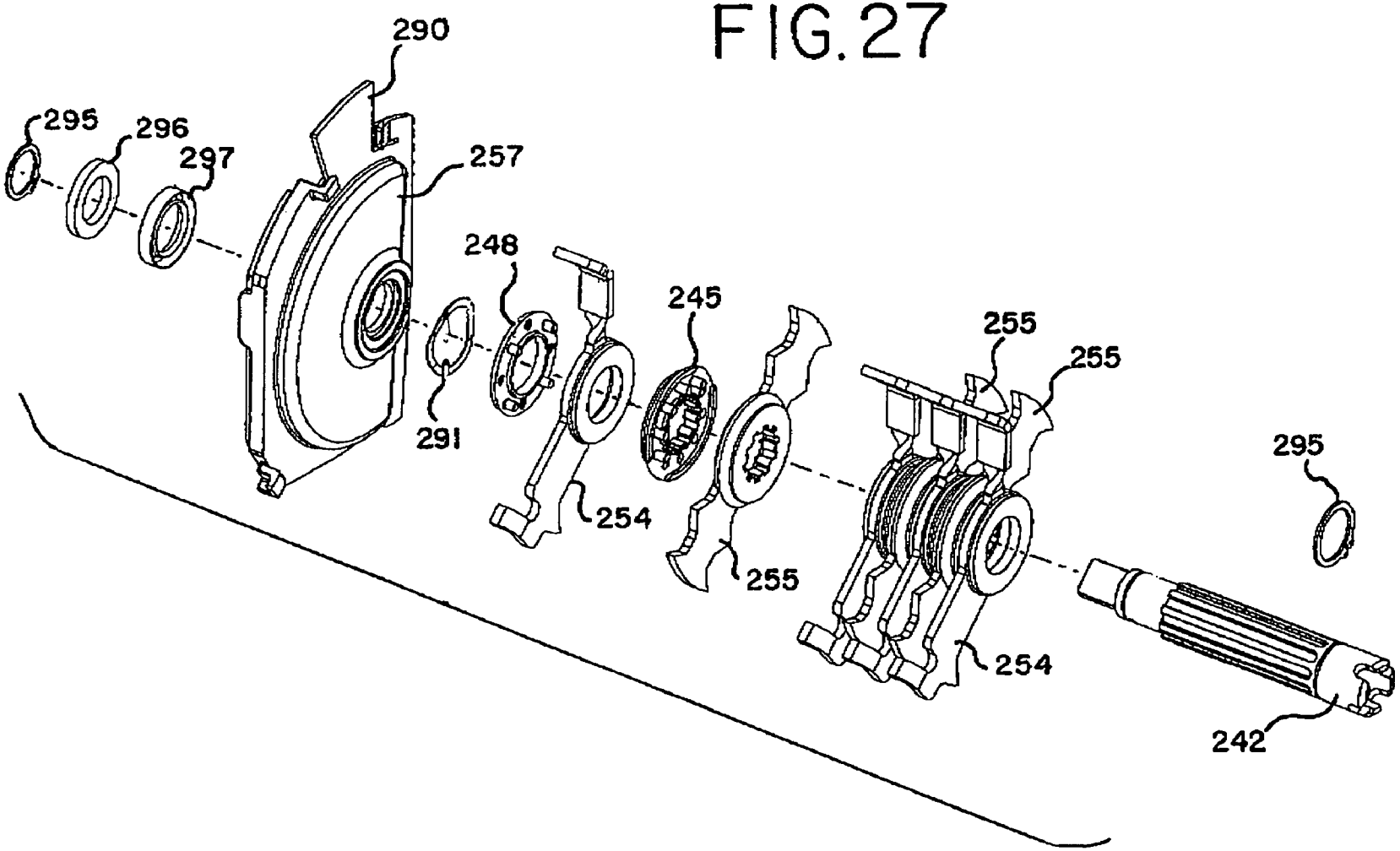
FIG. 27 is an exploded view of the internal elements of the ice crusher used on the combined ice and beverage dispensers of FIG. 18 and FIG. 23.

The design of the ice crusher 350, motor 323, rotary solenoid 330, door 334 and arm 332 on dispenser 310 is the same as the corresponding parts on dispenser 210. Likewise, the control of these components is essentially the same. FIG. 25 shows a circuit diagram for the dispenser 310. Many components are the same as the schematic diagram of FIG. 22 for dispenser 210. Since the dispenser 310 has two paddlewheels in areas 362 and 363, there are two motors, left motor 376 and right motor 377, for powering the paddlewheels. There are also two transformers 380, each supplying low voltage power to a separate set of mixing and dispensing valves 326. Switch 375 is activated when the cubed ice dispenser is pushed, which then activates right motor 377. There are also optionally two merchandiser lamps 364, with associated ballasts 383 and starters 385. The capacitor 386 and relay 387 for the crusher motor are shown in FIG. 25. These items, and a few additional unnumbered items, such as nuts, screws, washers, mounting brackets, a timer, electrical box, and other minor items, are shown in the exploded views of FIGS. 23 and 26. FIG. 25 also shows the switch 371 that gets activated when dispensing chute 324 or optional lever 372 is pushed, pivoting on rod 373; the kill switch 374 (also shown in FIG. 26); and optional agitator timers 388 that can be included to rotate the paddlewheels if no one dispenses ice for a predetermined amount of time, thus keeping ice cubes in the bin from sticking together.

Figure 28:
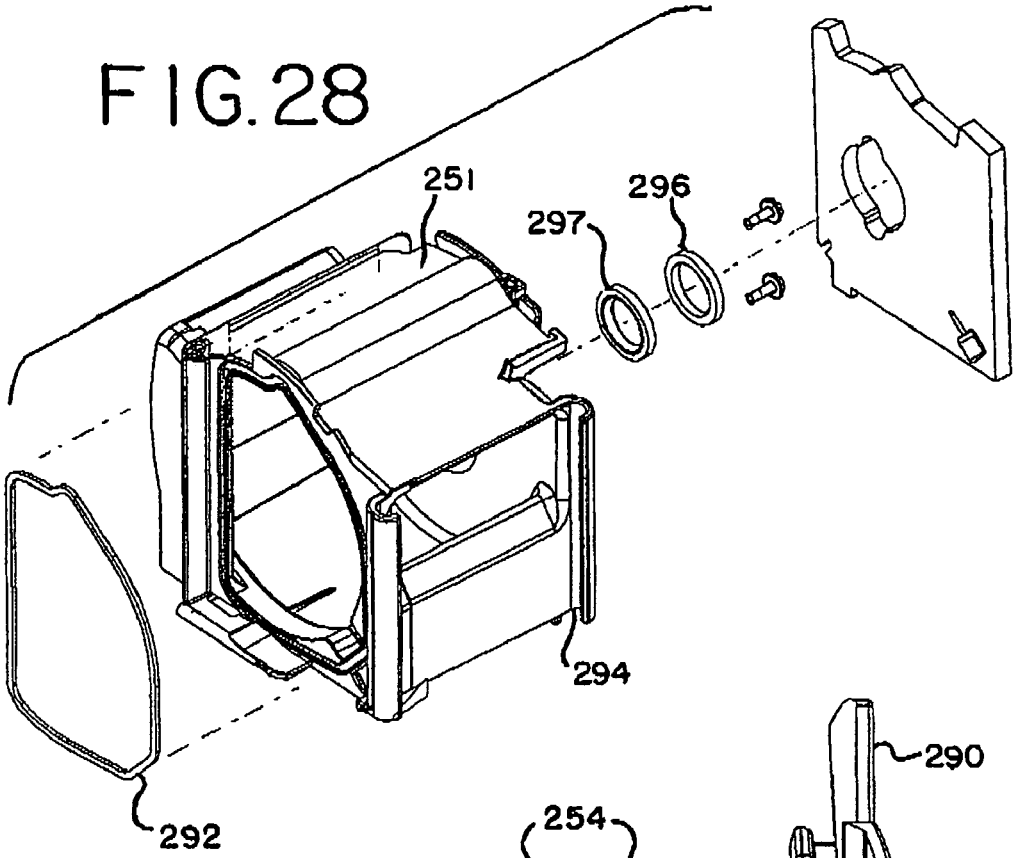
FIG. 28 is an exploded view of the housing of the ice crusher used on the combined ice and beverage dispensers of FIG. 18 and FIG. 23.
Figure 29:
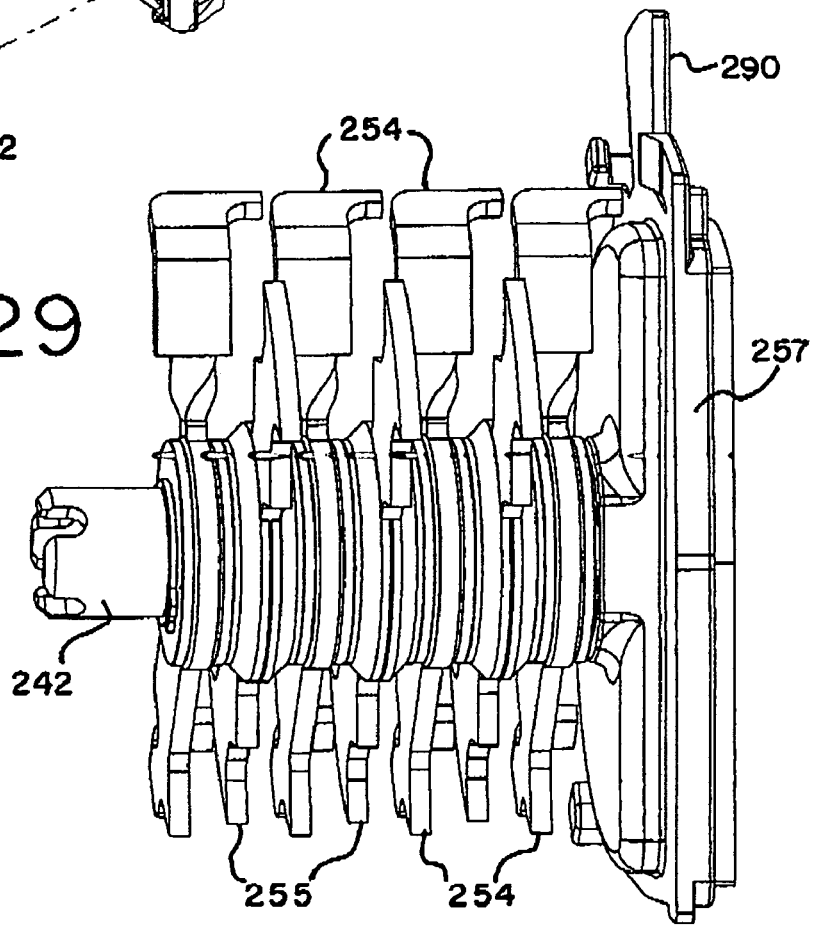
FIG. 29 is an enlarged perspective view of the crushing blades used in the ice crusher of FIGS. 27 and 28.
Figure 30:
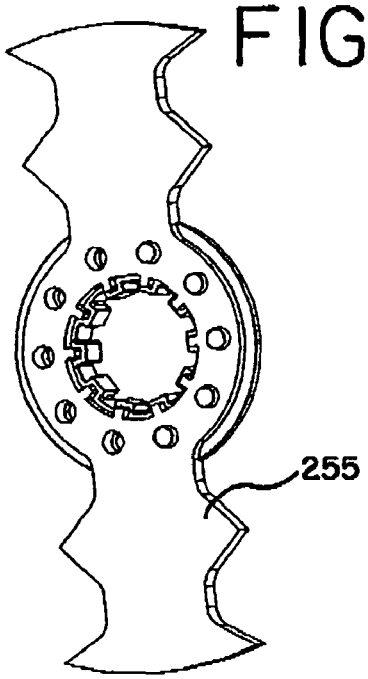
FIGS. 30-34 are perspective views of the components used in the ice crusher of FIGS. 27 and 28.
Figure 31:
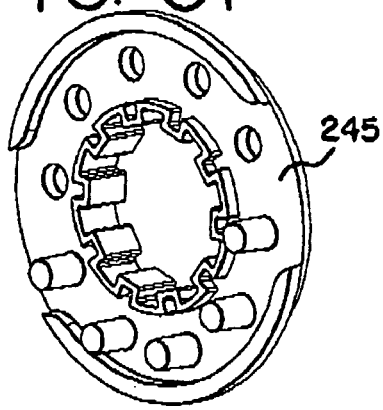
Figure 32:
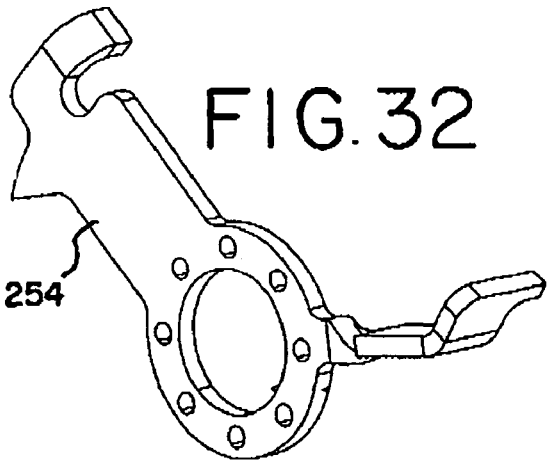
Figure 33:
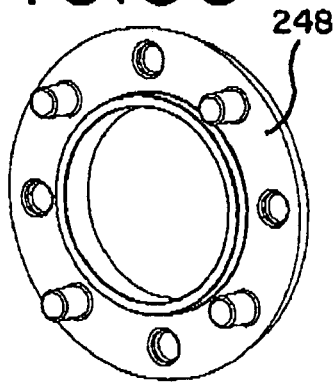
Figure 34:
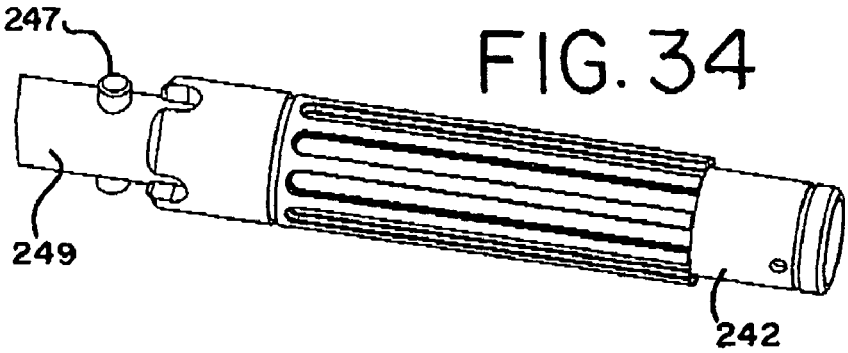

Detailed and exploded views of the ice crusher 250 and its components are shown in FIGS. 27-34. Ice crusher 350 used on the combined ice and beverage dispenser 310 is just the same as ice crusher 250. Many of the pieces of ice crusher 250 are very similar to those used in the ice crusher 50, such as the stationary bushing (spacer) 248 and the rotating bushing (spacer) 245, and will therefore not be explained again in detail. Some of the more significant differences, however, are as follows. As noted earlier, the housing 251 for the ice crusher 250 does not include a holding chamber. The shape of the wiping section on non-rotating blades 254 is slightly different. The removable door 257 has a different shape, and includes a tab 290 that can be grasped to detach the door 257 from the rest of the housing 251 by rotating the door 5° counter-clockwise. When the door is put on, a living hinge allows detents to snap it into place. A gasket 292 is provided to help seal the door 257. The housing 251 includes guides 294 in which the outlet door 234 slides up and down. Drive shaft 249 and driven shaft 242 interface differently, using a protruding pin 247 in the drive shaft, rather than dog teeth. A spring wave washer 291 is provided between the last stationary bushing and the door 257. Bushings 296 and seals 297 are provided on the outside of door 257 (FIG. 27) and inside the housing 251 against the outer wall (FIG. 28). Retaining rings 295 are used to hold the assembly together. The blades 254 and 255 thus come out of the housing 251 with the door when the door 257 is removed.

The present invention may be applied to existing ice dispensers or existing combined ice and beverage dispensers. Particularly, the preferred embodiments of the ice crusher designs that do not need additional height on the basic machine to accommodate them are useful for retrofitting an existing dispenser. A retrofit kit for this use will include an ice crusher and a dispensing chute. The ice crusher will be attachable to the existing dispenser, in the area where cubed ice is currently dispensed. The new ice dispensing chute will be attachable to the ice crusher. Ice crusher and chute designs described above can thus be combined to provide a retrofit kit. The ice crusher could be wired in parallel with wiring used to activate the paddlewheel motor when the ice dispensing chute is pushed.

There are many embodiments of the present invention, of which only a few presently-preferred embodiments have been described. For instance, rather than using non-rotating blades to react and crush the ice as the rotating blades, the ice crusher could be made with blades or elements of fixed position molded or assembled into the housing. For purposes of this patent, such fixed elements are equivalent to a "non-rotating blade." Instead of having wipers on the non-rotating blades, a wiper could instead be part of the rotating crusher blades. Rather than mounting the crusher as shown in FIGS. 1 and 4, the crusher could be mounted at a 90° angle, with the crushing blades moving in a horizontal or lateral plane, rather than vertical. Rather than using a rotary solenoid to open doors, a mechanical linkage could be used. As noted earlier, other crushing mechanisms could be used, such as a sonic crusher. It is intended that the foregoing detailed description be regarded as illustrative rather than limiting, and that it be understood that it is the following claims, including all equivalents, that are intended to define the spirit and scope of this invention.

The invention claimed is:

1. A combination of a beverage dispenser and an ice crusher, the combination comprising:

a) a beverage dispenser having an ice bin for storing ice cubes and a cold plate, wherein syrup for at least one beverage is routed through tubing in the cold plate;

b) an ice crusher housing having an inlet connected to the ice bin;

c) an ice crusher within the ice crusher housing forming crushed ice from the ice cubes, the ice crusher comprising at least one rotating crusher blade and at least one non-rotating crusher blade within the ice crusher housing, the ice crusher further comprises a wiper removing crushed ice from the rotating crusher blade, the crushed ice being lifted by the rotating crusher blade after the crushed ice is formed and before it contacts the wiper; and d) a crushed ice outlet from the ice crusher housing; and wherein the ice crusher and housing are configured and attached to the dispenser such that ice is raised in elevation between a place in the ice crusher housing where the crushed ice is formed and the crushed ice outlet.

2. The combination of claim 1 wherein the ice bin is not refrigerated, ice cubes from the ice bin are fed to the ice crusher by a downward sloping chute and the bottom of the ice crusher housing outlet is at least as high in elevation as the bottom of the ice crusher housing inlet.

3. The combination of claim 1 wherein the ice bin further comprises a cubed ice outlet, wherein a user may dispense crushed ice from the crushed ice outlet or cubed ice from the cubed ice outlet.

4. The combination of claim 3 wherein the crushed ice outlet and the cubed ice outlet both connect to the same dispensing chute.

5. The combination of claim 3 wherein the crushed ice outlet and the cubed ice outlet each connect to different dispensing chutes.

6. The combination of claim 1 further comprising a motor and a drive shaft connected to the motor, wherein the drive shaft has an interface for driving each of the at least one rotating crusher blades.

7. The combination of claim 1 wherein the ice crusher housing outlet is connected to a dispensing chute.

8. The combination of claim 1 wherein the ice crusher housing further comprises a door adjacent to and normally closing the crushed ice outlet that can be opened to allow crushed ice to be dispensed through the crushed ice outlet.

9. The combination of claim 1 wherein the ice crusher housing comprises at least one removable side.

10. The combination of claim 1 further comprising an ice maker having an outlet positioned to deliver ice to the ice bin.

11. The combination of claim 1 wherein the wiper is provided by a part formed on each of the at least one non-rotating crusher blades.

12. The combination of claim 3 comprising one switch for selecting whether cubed ice or crushed ice will be dispensed and a second switch for activating dispensing of the ice.

13. The combination of claim 12 wherein the ice crusher housing further comprises a door adjacent to and normally closing the crushed ice outlet that can be opened to allow crushed ice to be dispensed through the crushed ice outlet.

14. The combination of claim 1 wherein a paddlewheel is located in the ice bin and is used to transfer ice to the ice crusher housing.

15. The combination of claim 3 further comprising at least one mixing and dispensing valve for mixing said syrup and water and dispensing a beverage and wherein cubed ice may pass from the ice bin and into the ice crusher when the user selects to dispense crushed ice and wherein cubed ice may pass from the ice bin through the cubed ice outlet when the user selects to dispense cubed ice.

16. The combination of claim 15 wherein first and second solenoid-activated doors are used to control whether the dispenser will deliver cubed ice or crushed ice, and the second door is downstream of the ice crusher.

17. The combination of claim 16 further comprising a selector for selecting whether the dispenser will deliver cubed ice or crushed ice and wherein when cubed ice is selected on the selector and ice dispensing is activated, the first solenoid-activated door opens the cubed ice outlet and cubed ice is dispensed, and when crushed ice is selected on the selector and ice dispensing is activated, the ice crusher is activated and the second solenoid-activated door is opened, allowing crushed ice from the ice crusher to be dispensed.

18. The combination of claim 1 wherein the ice crusher further comprises a safety guard pivotally mounted so that its bottom can swing away from the ice crusher, allowing crushed ice to pass into a dispensing chute, but the guard can only swing back to a position where it stops to prevent someone from sticking a finger up into the chute and getting it in contact with the ice crusher.

19. The combination of claim 1 wherein the crushed ice outlet is not at the bottom of the housing.

* * * * *